US011696664B2

(12) United States Patent
Io et al.

(10) Patent No.: US 11,696,664 B2
(45) Date of Patent: Jul. 11, 2023

(54) CLEANING APPARATUS

(71) Applicant: OMRON Corporation, Kyoto (JP)

(72) Inventors: Kazuhiro Io, Tokyo (JP); Koji Sugita, Tokyo (JP); Tomokazu Imae, Tokyo (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 17/578,581

(22) Filed: Jan. 19, 2022

(65) Prior Publication Data

US 2022/0279996 A1 Sep. 8, 2022

(30) Foreign Application Priority Data

Mar. 8, 2021 (JP) ..... 2021-036024

(51) Int. Cl.

| | |
|---|---|
| ***A47L 5/34*** | (2006.01) |
| ***A47L 9/00*** | (2006.01) |
| ***A47L 9/04*** | (2006.01) |
| ***A47L 9/06*** | (2006.01) |
| ***A47L 9/14*** | (2006.01) |

(52) U.S. Cl.

CPC ..... *A47L 5/34* (2013.01); *A47L 9/009* (2013.01); *A47L 9/0494* (2013.01); *A47L 9/066* (2013.01); *A47L 9/1463* (2013.01)

(58) Field of Classification Search

CPC ..... A47L 5/34; A47L 9/009; A47L 9/0494; A47L 9/066; A47L 9/1463; A47L 9/0477; A47L 11/18; A47L 11/4055; A47L 9/00; A47L 9/0018; A47L 9/02; A47L 9/04

See application file for complete search history.

(56) References Cited

U.S. PATENT DOCUMENTS

| | | | | |
|---|---|---|---|---|
| 3,579,699 | A | 5/1971 | Balzer et al. | |
| 2009/0255082 | A1 | 10/2009 | Park et al. | |
| 2021/0161341 | A1* | 6/2021 | Imae | A47L 9/0477 |
| 2021/0235956 | A1* | 8/2021 | Mizoguchi | A47L 11/4013 |

FOREIGN PATENT DOCUMENTS

| | | | |
|---|---|---|---|
| JP | 2000-279353 | A | 10/2000 |
| JP | 2020-048981 | A | 4/2020 |

OTHER PUBLICATIONS

Extended European search report dated Aug. 1, 2022 in a counterpart European patent application.

* cited by examiner

*Primary Examiner* — David Redding

(74) *Attorney, Agent, or Firm* — Metrolex IP Law Group, PLLC

(57) ABSTRACT

A cleaning apparatus may include a cleaning unit that is kept from moving downwardly from a predetermined limit position. The apparatus body includes a positioning member that positions the cleaning unit at the limit position. The cleaning unit includes an intake nozzle that is arranged at a position separated from the surface to be cleaned by a predetermined gap, a cam member that holds the cleaning unit at the limit position, and an operation input unit that changes the limit position to a higher position by moving the cleaning unit upward by operating the cam member.

8 Claims, 15 Drawing Sheets

CLEANING APPARATUS

CROSS-REFERENCES TO RELATED APPLICATIONS

This application claims priority to Japanese Patent Application No. 2021-036024 filed Mar. 8, 2021, the entire contents of which are incorporated herein by reference.

FIELD

The present disclosure relates to a cleaning apparatus for cleaning a surface to be cleaned while moving on the surface to be cleaned.

BACKGROUND

Heretofore, autonomously moving cleaning apparatuses referred to as cleaning robots are known. An autonomous cleaning apparatus cleans a surface to be cleaned by suctioning in dust from the surface to be cleaned along with taking air through a suction port of an intake nozzle oriented toward the surface, while moving on the surface such as a floor surface. The dust that is suctioned in (including objects that are suctioned in) is collected in a dust collection box attached to the cleaning apparatus.

A floor surface cleaning robot in which the height position of a dust collecting apparatus is adjustable is known (refer to JP 2000-279353A) as an example of these cleaning apparatuses. The position adjustment mechanism provided in the floor surface cleaning robot is configured such that the gap between an intake nozzle of the dust collecting apparatus and the floor surface may be manually adjusted depending on the state of the floor surface.

JP 2000-279353A may be an example of the related art.

However, in known floor surface cleaning robots, when there is a level difference in the floor surface, if the intake nozzle strongly comes into contact with the level difference, the contact portion may be damaged. Specifically, in the known floor surface cleaning robots, springs are provided in auxiliary wheels for keeping the amount of the gap between the intake nozzle and the floor surface, and therefore it is conceivable that if the height of the level difference is less than the stroke of these springs, the auxiliary wheels may pass over the level difference. However, in actuality, the springs exhibit a downward elastic force in response to an upward force received when the auxiliary wheels pass over the level difference, and the upward movement of the auxiliary wheels is hampered. When moving relatively slowly, the floor surface cleaning robot may pass over the level difference, but if the moving speed is relatively high, it is conceivable that the intake nozzle strongly collides with the level difference before passing over the level difference, and the intake nozzle is damaged. In particular, in the known floor surface cleaning robots, if the position of a dust collecting apparatus is adjusted to a higher position, the elastic force of the springs increases, and therefore passing over a level difference becomes more difficult.

Specifically, an autonomously moving cleaning apparatus for industrial use has a large and heavy structure in order to achieve a high performance needed for industrial applications. Therefore, when there is a level difference in a surface to be cleaned such as a floor surface, for example, if the intake nozzle strongly comes into contact with the level difference, the contact portion is easily damaged. Also, in addition to the contact portion being damaged, if an end portion of the intake nozzle strongly comes into contact with the level difference, a high load is incurred in the moving direction, and the cleaning apparatus may turn, and in some cases, the cleaning apparatus may topple over.

Also, some known floor surface cleaning robots are provided with an elevating means. An elevating means is for elevating the auxiliary wheels and the dust collecting apparatus to an elevated position that is spaced apart upward from the floor surface. However, the position adjustment mechanism in the known floor surface cleaning robots is for enabling position adjustment in a state in which the dust collecting apparatus is elevated to the elevated position by the elevating means, and the position adjustment task is complex.

Incidentally, it is conceivable that, as a result of elevating the dust collecting apparatus to the elevated position using the elevating means, even if the floor surface cleaning robot encounters the level difference when being caused to move without performing cleaning, for example, the intake nozzle may be prevented from colliding with the level difference. However, the elevating means is for elevating the dust collecting apparatus by causing a link mechanism, a suspension metal fitting, and the like to operate by selectively extending and contracting a plurality of cylinders, and the structure thereof is complicated.

SUMMARY

In a cleaning apparatus according to one or more embodiments, even if there is a level difference in a surface to be cleaned, an intake nozzle may be prevented from being damaged due to collision with the level difference when passing over the level difference by retreating the intake nozzle upward, and also, the intake nozzle may be retracted to an upward position from the surface to be cleaned with a simple configuration such that the intake nozzle will not come into contact with the level difference when the cleaning apparatus moves without performing cleaning.

Also, In a cleaning apparatus according to one or more embodiments, an intake nozzle of a cleaning unit may be easily retracted to an upward position with a simple operation.

(1) A cleaning apparatus according to one or more embodiments may have a cleaning function for cleaning a surface to be cleaned while moving on the surface to be cleaned. A cleaning apparatus according to one or more embodiments may include an apparatus body and a cleaning unit that is supported so that it is movable in a vertical direction relative to the apparatus body, and is kept from moving downwardly from a predetermined limit position. The apparatus body includes a positioning member for positioning the cleaning unit at the limit position. The cleaning unit includes: an intake nozzle that is arranged at a position separated from the surface to be cleaned by a predetermined gap; a cam member configured to hold the cleaning unit at the limit position by a cam face being supported on an upper face of the positioning member; and an operation input unit configured to apply a force in a rotating direction of the cam member to the cam member, and change the limit position to a higher position by moving the cleaning unit upward by operating the cam member.

As a result of the above described configuration, even if there is a level difference in a surface to be cleaned when the cleaning apparatus performs cleaning, the cleaning unit is moved upward from the limit position by an upward force generated due to the intake nozzle coming into contact with the level difference. Accordingly, a strong collision between the intake nozzle and a level difference may be avoided, and damage to the intake nozzle may be prevented. Also, when the cleaning apparatus is caused to move without performing cleaning, the limit position may be changed upward to a position at which the intake nozzle will not come into contact with the level difference. Accordingly, the intake nozzle will not come into contact with a level difference when the cleaning apparatus moves without performing cleaning, and therefore the movement at the time of not performing cleaning is not hampered by a level difference, and smooth movement may be realized.

(2) In the cleaning apparatus according to one or more embodiments, the cleaning unit includes a rotator that is provided in the cleaning unit such that its outer circumferential surface is positioned between a circumferential edge portion of a suction port of the intake nozzle and the surface to be cleaned. The cleaning unit is configured to retreat upward from the limit position by the cam member separating upward from the positioning member due to an upward external force being applied to the rotator, and return to the limit position by the cam member coming into contact with the upper face of the positioning member due to the external force being cancelled.

As a result of the above described configuration, when the cleaning apparatus moves and the intake nozzle approaches a level difference on the surface to be cleaned, the rotator comes into contact with the level difference before the intake nozzle comes into contact with the level difference, and rides over the level difference. Here, the rotator receives an upward external force from the level difference. The entirety of the cleaning unit is moved upward by the external force. As a result, the intake nozzle coming into contact with the level difference may be avoided, and a damage, abnormal movement, toppling over, or the like that is incurred due to the contact between the intake nozzle and the level difference may be avoided.

(3) In the cleaning apparatus according to one or more embodiments, the cleaning unit includes: a collection box configured to collect objects to be suctioned in that are suctioned in through the suction port; and a support member that is provided with the intake nozzle in a lower end portion, and is configured to support the collection box above the intake nozzle, and be supported by a back face of the apparatus body so that it is movable in a vertical direction. The operation input unit is provided in the support member such that a rotational operation may be received, and the cam member is attached to a rotating shaft of the operation input unit.

As a result of the above described configuration, a user may easily adjust the limit position of the cleaning unit by operating the operation input unit. Accordingly, when the cleaning unit is caused to move without performing cleaning, for example, the intake nozzle of the cleaning unit may be easily retracted to an upward position at which the intake nozzle will not come into contact with a level difference.

(4) In the cleaning apparatus according to one or more embodiments, the cleaning unit includes a fixing mechanism configured to fix the cam member at a position determined by rotation operation of the cam member.

As a result of the above described configuration, the position of the cleaning unit in the vertical direction may be easily fixed.

(5) In the cleaning apparatus according to one or more embodiments, the fixing mechanism includes: a fixing plate that is provided in the support member, and in which a plurality of engagement holes are formed; and a lock member that is provided in the operation input unit, and includes a protrusion that may be inserted into the engagement holes.

As a result of the above described configuration, the position of the cleaning unit in the vertical direction may be adjusted to a desired position by inserting the protrusion to an appropriate engagement hole, and may also be fixed to the desired position.

(6) In the cleaning apparatus according to one or more embodiments, the fixing mechanism further includes an elastic member that applies a force to the lock member in a direction in which the protrusion approaches the engagement holes.

As a result of the above described configuration, the state in which the protrusion is inserted into one engagement hole may be maintained by a force applied by the elastic member. Accordingly, the fixing by the fixing mechanism will not be released due to vibration or the like when moving, and therefore a cleaning apparatus that may safely move may be realized.

(7) In the cleaning apparatus according to one or more embodiments, the support member includes a housing portion having a recessed shape that is recessed on the back face side for accommodating the collection box, and is configured to support the collection box such that the collection box may be attached and detached. The operation input unit is provided in a side face on the back face side of the housing portion.

As a result of the above described configuration, the operation input unit is not exposed to the outside. Therefore, the operation input unit is prevented from being inadvertently operated while the cleaning apparatus is operating, and therefore the safety of the cleaning apparatus while moving may be ensured. Also, the operation input unit is exposed such that an operation may be received by merely removing the collection box that may be attached to and removed from the apparatus body, and therefore the user may easily access and easily operate the operation input unit.

(8) The cleaning apparatus according to one or more embodiments further includes a drive transmission unit configured to transmit a moving force in a moving direction of the cleaning apparatus to the surface to be cleaned while keeping a moving posture of the apparatus body.

As a result of the above described configuration, the cleaning apparatus may move autonomously.

According to one or more embodiments, even if there is a level difference in a surface to be cleaned, an intake nozzle may be prevented from being damaged due to collision with the level difference when passing over the level difference by retreating the intake nozzle upward, and also, the intake nozzle may be retracted to an upward position from the surface to be cleaned with a simple configuration such that the intake nozzle will not come into contact with the level difference when the cleaning apparatus moves without performing cleaning.

Also, according to one or more embodiments, an intake nozzle of a cleaning unit may be easily retracted to an upward position with a simple operation.

BRIEF DESCRIPTION OF THE DRAWINGS

FIG. 6A is a diagram illustrating a state in which a collection box of a cleaning apparatus is attached, and FIG. 6B is a diagram illustrating a state in which a collection box of a cleaning apparatus has been removed.

FIG. 13 is a diagram illustrating a cross-sectional view of a state in which engagement is canceled due to an adjustment dial being pushed in.

DETAILED DESCRIPTION

Figure 1:
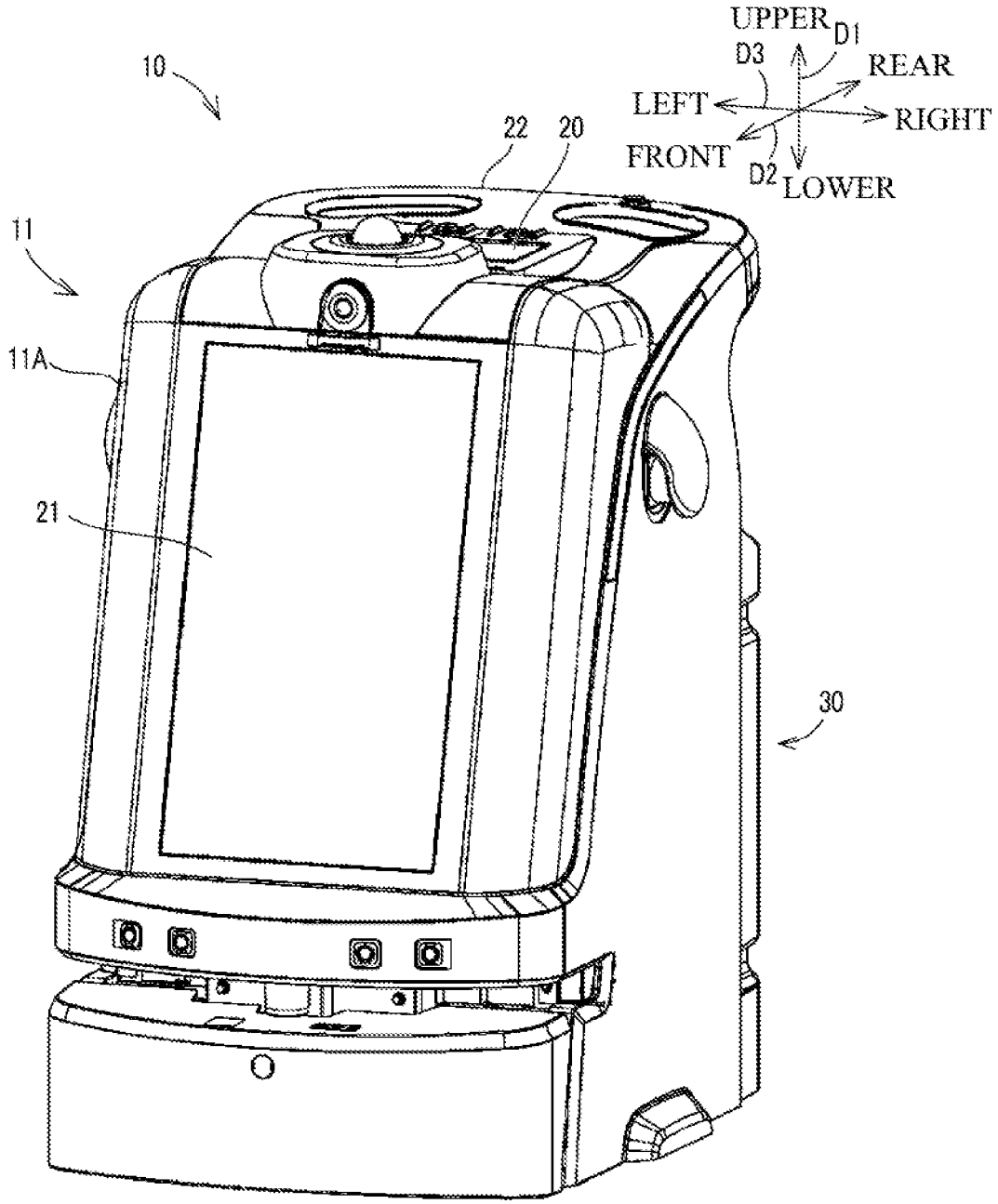
FIG. 1 is a diagram illustrating a perspective view of an exterior appearance, taken from the front, of a cleaning apparatus according to one or more embodiments.

Hereinafter, one or more embodiments will be described with reference to the drawings. Note that the following descriptions are merely a specific example or examples in accordance with one or more embodiments, and are not intended to be exhaustive or limit the scope of the invention. Note that a vertical direction D1, a front-back direction D2, and a horizontal direction D3 or a width direction D3 that are shown in the drawings are used for convenience and discussion purposes and do not limit possible orientations in accordance with various embodiments.

Cleaning Apparatus 10

Figure 2:
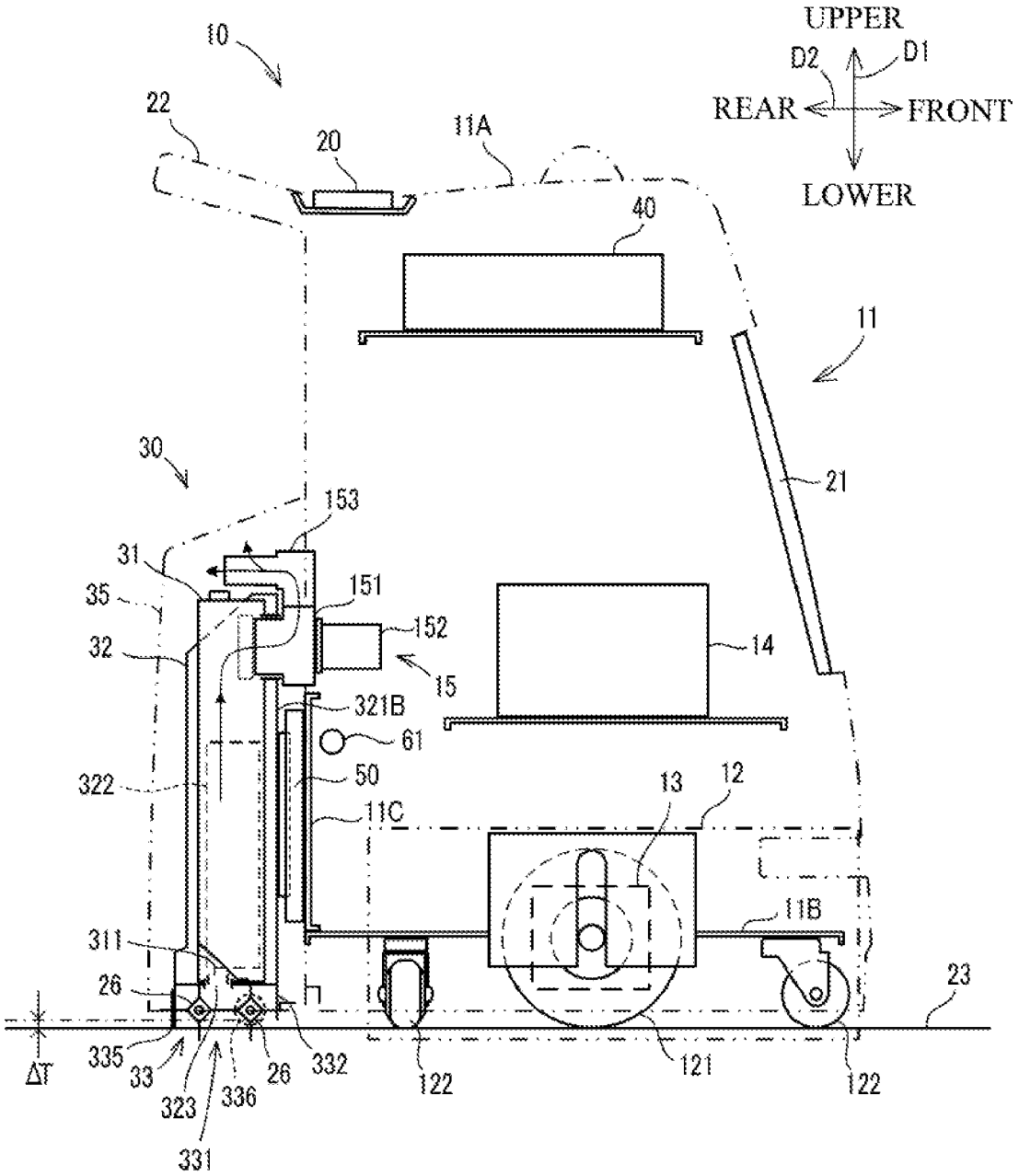
FIG. 2 is a schematic diagram illustrating an internal configuration of a cleaning apparatus.

FIG. 1 is a perspective view illustrating an exterior appearance, taken from the front of an autonomously moving cleaning apparatus 10 (an example of a cleaning apparatus) according to one or more embodiments. FIG. 2 is a schematic diagram illustrating an internal configuration of the cleaning apparatus 10.

The cleaning apparatus 10 shown in FIG. 1 is an autonomous moving apparatus that autonomously moves forward (in a moving direction) of a floor surface 23 (see FIG. 2) of a concourse of an airport, a station, a shopping mall, or the like, and is also referred to as a mobile robot. The cleaning apparatus 10 suctions up waste matters (including objects that may be suctioned in) such as dust, dirt, debris or other detritus on the floor surface 23, which is a surface to be cleaned, while moving autonomously, separates the waste matters using a filter, and collects the waste matters in a collection box 31 (see FIG. 2). The cleaning apparatus 10 automatically cleans the floor surface 23 while moving on the floor surface 23 based on various types of cleaning information such as a moving route, a cleaning area, a cleaning time slot, or a home position to which the cleaning apparatus 10 returns for charging.

Note that the cleaning apparatus 10 is merely an example of a cleaning apparatus, and one or more embodiments may also be applied to a cleaning apparatus that cleans an indoor floor surface 23 while autonomously moving thereon, a cleaning apparatus that cleans road surfaces of an outdoor footway and a road while autonomously moving thereon, and the like. Also, the cleaning apparatus 10 need only be an autonomously moving mobile robot that has at least a cleaning function, and is not limited to a cleaning apparatus 10 that has only a cleaning function. For example, one or more embodiments may also be applied to an autonomously moving mobile robot that has other functions for the purpose of other applications, in addition to the cleaning function. For example, one or more embodiments may also be applied to autonomously moving apparatuses such as a mobile robot that has a guarding function while autonomously moving, a mobile robot that has a caretaking function, a mobile robot that has a load carriage function, and a mobile robot that has a display and guide function, in addition to the cleaning function. Also, one or more embodiments may also be applied to a manual type cleaning apparatus that cleans a floor surface 23 while being moved by manual pushing by a worker, for example, in addition to mobile robots that move autonomously.

As shown in FIG. 2, the cleaning apparatus 10 includes an apparatus body 11, and a cleaning unit 30 provided in the apparatus body 11. The apparatus body 11 is provided with a moving unit 12 (an example of a driving force transmission unit of one or more embodiments), motors 13, a battery 14, a console unit 20, a display panel 21, an operating handle 22, a control unit 40, and the like. The cleaning apparatus 10 also includes a sliding mechanism 50 (see FIG. 2) that supports the cleaning unit 30 so that it is movable in the vertical direction D1, and a position adjustment mechanism 60 (see FIG. 8) that can adjust the height position of the cleaning unit 30.

As shown in FIG. 1, the apparatus body 11 includes an exterior cover 11A that constitutes the exterior thereof. Also, as shown in FIG. 2, the apparatus body 11 includes a chassis 11B in its lower portion. The chassis 11B is provided substantially in parallel to the floor surface 23. Also, support frames for supporting the aforementioned functional units are provided, as appropriate, inside the apparatus body 11.

The apparatus body 11 is configured to move on the floor surface 23, which is a surface to be cleaned, in a predetermined moving direction. In the present embodiment or embodiments, the apparatus body 11 can move using the moving unit 12. As shown in FIG. 2, the moving unit 12 is provided in a lower portion of the apparatus body 11. The moving unit 12 is for transmitting the conveyance force, in the moving direction, to the floor surface 23 while keeping the moving posture of the apparatus body 11, and is attached to the chassis 11B. The moving unit 12 includes a pair of wheels 121 for movement and four casters 122.

The wheels 121 are attached rotatably on both sides of the chassis 11B in the horizontal direction D3 (width direction), at the center in the front-back direction. The four casters 122 are for keeping the moving posture of the apparatus body 11, and are attached rotatably on both sides at the forward end of the chassis 11B, and on both sides at the rear end of the chassis 11B. The outer circumferential surfaces of the wheels 121 and the casters 122 are supported by the floor surface 23 in a state in which the cleaning apparatus 10 is placed on the floor surface 23. Accordingly, the apparatus body 11 is kept in the moving posture, as shown in FIG. 1 and FIG. 2.

Rotating shafts of the wheels 121 are respectively connected to output shafts of the motors 13 via transmission mechanisms such as reduction gears. Therefore, when the motors 13 are driven, and rotational driving forces are output from the output shafts, the rotational driving forces of the motors 13 are transmitted to the wheels 121. In the present embodiment or embodiments, the motors 13 are provided individually to the two wheels 121. Therefore, the rotating speeds of the wheels 121 are controlled by individually controlling the driving of the motors 13. For example, when the rotating speeds of the wheels 121 are controlled to be the same, the cleaning apparatus 10 moves straight, and when the rotating speeds of the wheels 121 are controlled to be different, the cleaning apparatus 10 turns to the side of the wheel 121 that rotates more slowly.

The battery 14 is provided in a central portion of the apparatus body 11. The battery 14 supplies driving power to the motors 13 and motors 152 of intake fans 151 of an intake unit 15, which will be described later.

The console unit 20 is provided in an upper portion of the apparatus body 11. The console unit 20 is attached to the exterior cover 11A. The console unit 20 is a device to be operated by a worker, and is a terminal apparatus including a touch panel on which a touch operation can be performed, for example. Various types of registration information (information such as a moving route, a cleaning area, a cleaning time slot, and home position information) for the cleaning apparatus 10 can be input through the console unit 20. The input registration information is transferred to the control unit 40, and is used for movement control performed by the control unit 40.

The display panel 21 is provided in a front face of the apparatus body 11. The display panel 21 is a liquid crystal panel, for example. Various types of announcement information are displayed in the display panel 21 by the control unit 40 while cleaning is performed. The announcement information is information indicating the fact that cleaning is underway, guidance information regarding the floor on which cleaning is performed, and the like.

The operating handle 22 is provided in an uppermost portion of a back face of the apparatus body 11. The operating handle 22 is an operation member that is held by a worker when the worker performs cleaning by manually operating the cleaning apparatus 10, or when the worker performs a teaching operation (instructing operation) for instructing the moving route to the cleaning apparatus 10. The operating handle 22 is provided with various operation buttons for receiving driving operations from a worker. Information regarding operations performed on the operation buttons is transferred to the control unit 40, and is used for movement control performed by the control unit 40.

As shown in FIG. 2, the control unit 40 is provided in the upper portion of the apparatus body 11. The control unit 40 controls movement of the cleaning apparatus 10, driving of the motors 152 of the intake unit 15, screen display of the display panel 21, and the like. The control unit 40 includes control devices such as a CPU, a ROM, and a RAM, storage devices such as an HDD and a flash memory, a GPS receiver, and the like. The CPU is a processor that executes various types of computational processes. The ROM is a nonvolatile memory in which control programs such as a BIOS, an OS and higher level programs for causing the CPU to execute various types of processes are stored in advance. The RAM is a volatile or nonvolatile memory for storing various types of information, and is used as a temporary memory (work area) for the various types of processes to be executed by the CPU. The control unit 40 controls movement of the cleaning apparatus 10, driving of the motors 152, screen display of the display panel 21 and the like by causing the CPU to execute the various types of control programs that are stored in the ROM or a storage apparatus in advance.

Cleaning Unit 30

Figure 3:
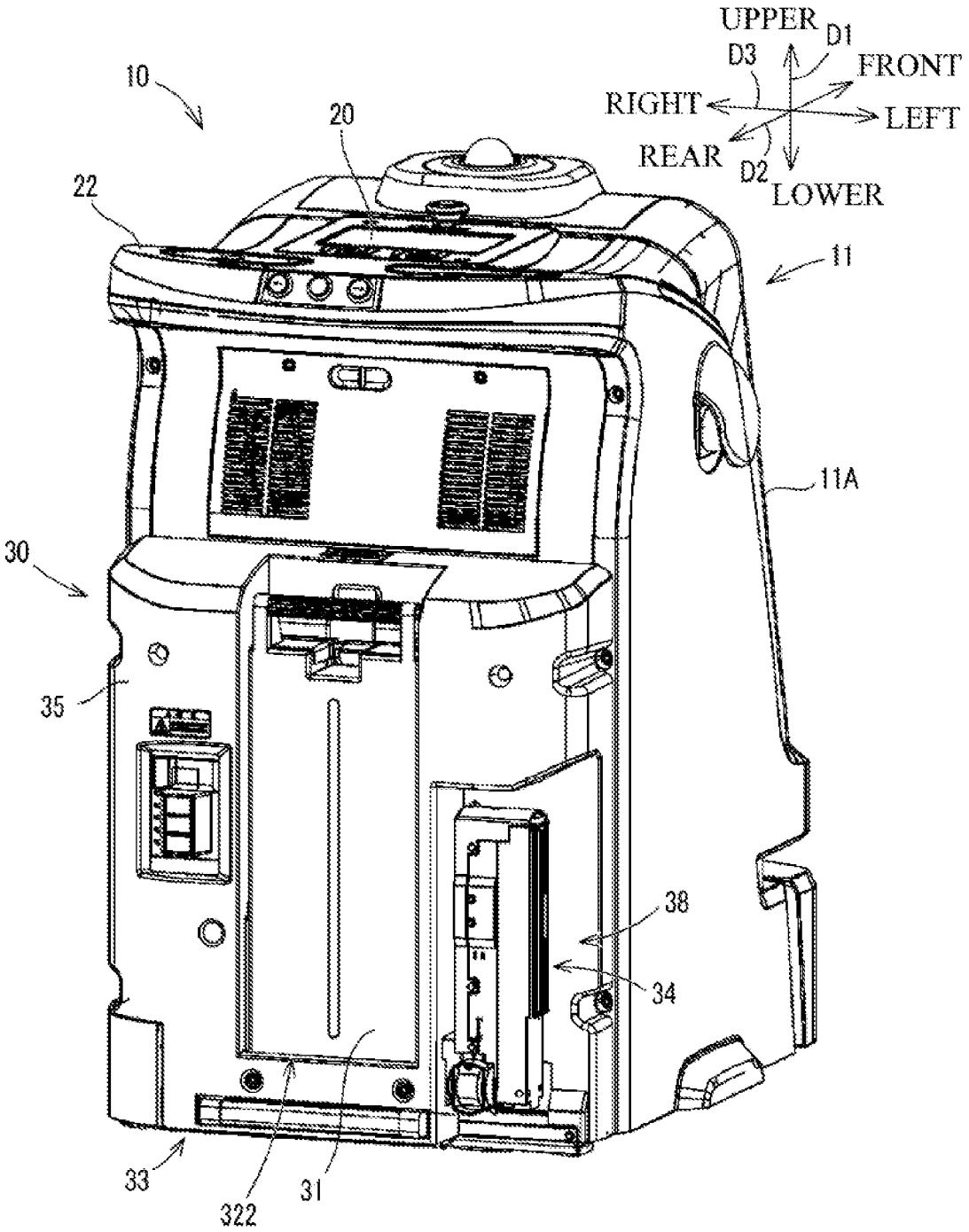
FIG. 3 is a diagram illustrating a perspective view of an exterior appearance, taken from a rear side, of a cleaning apparatus.

FIG. 3 is a perspective view illustrating an exterior appearance, taken from the rear side, of the cleaning apparatus 10. As shown in FIG. 2 and FIG. 3, the cleaning unit 30 is provided on the back face of the apparatus body 11. The cleaning unit 30 is supported by a back face frame 11C included in the apparatus body 11 via the sliding mechanism 50, which will be described later, and is movable in the vertical direction D1.

The cleaning unit 30 includes a collection box 31, a support holder 32 (an example of a support member of one or more embodiments), an intake nozzle 33, an extension nozzle 34 (see FIG. 3), an intake unit 15, and a cover 35.

The support holder 32 is provided on the back face of the apparatus body 11. The support holder 32 is a supporting member that supports the collection box 31 such that the collection box 31 can be attached and removed. The collection box 31 is attached to the support holder 32 and is removable.

Figure 4:
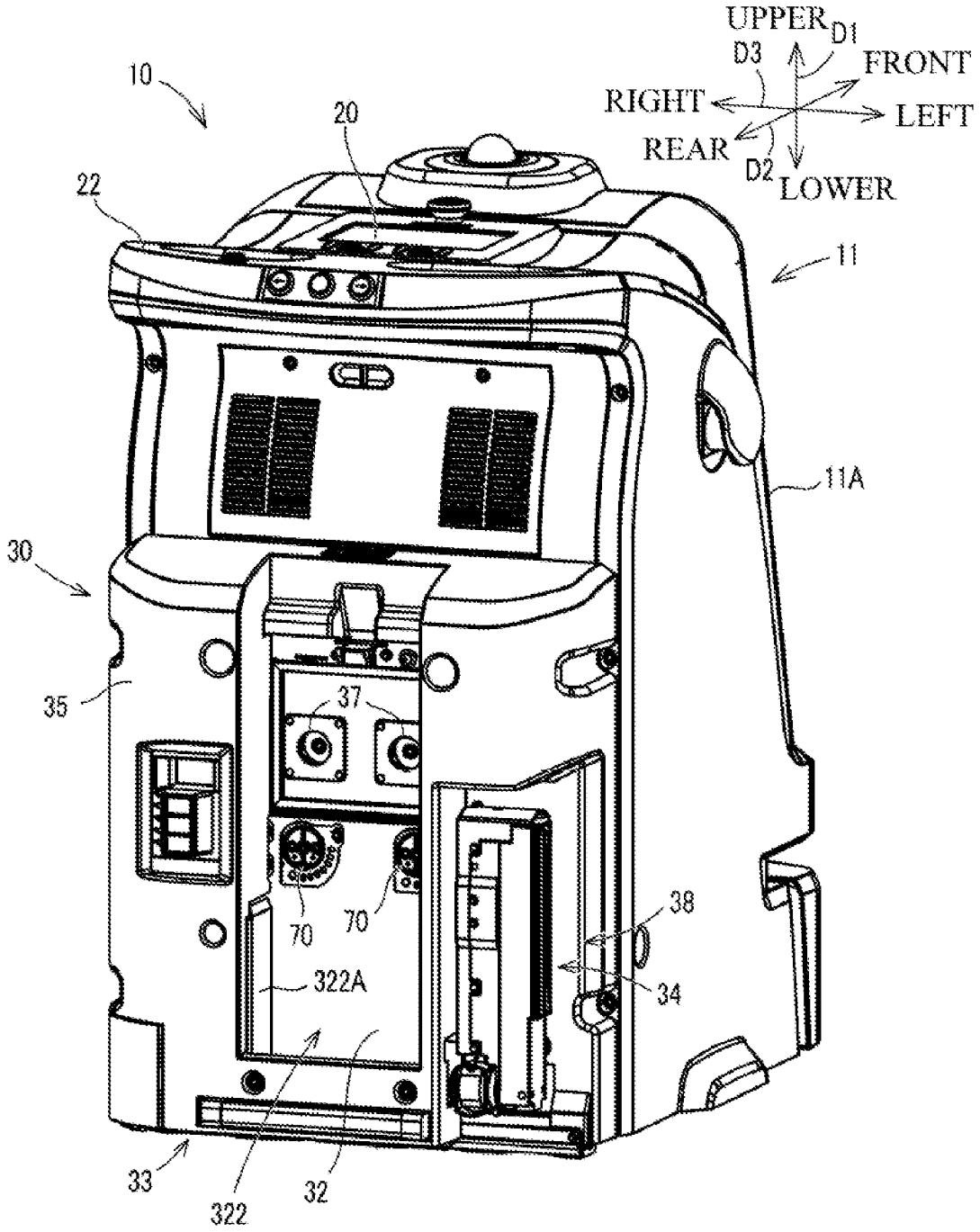
FIG. 4 is a diagram illustrating a perspective view of a state in which a collection box is removed in a perspective view, such as is illustrated in FIG. 3.
Figure 5:
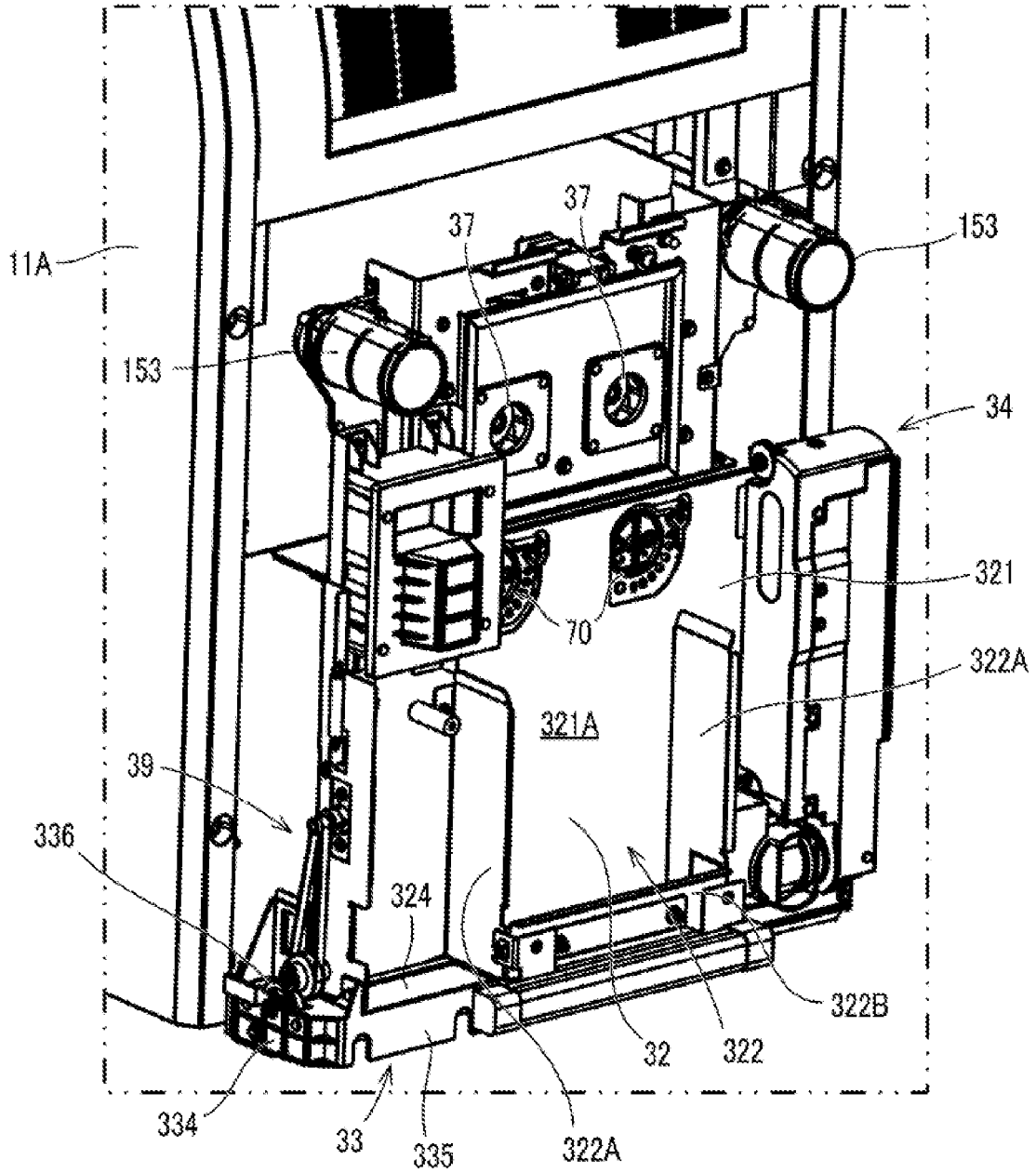
FIG. 5 is a diagram illustrating a partial enlarged view of a state in which a back face cover is removed in a perspective view, such as is illustrated in FIG. 4, and shows an internal structure of a cleaning unit.

FIG. 4 is a perspective view illustrating a state in which the collection box 31 is removed from the support holder 32, and FIG. 5 is a partial enlarged view illustrating a state in which the cover 35 is removed in the perspective view in FIG. 4. As shown in FIG. 4 and FIG. 5, the cover 35 is attached to the support holder 32.

A housing portion 322 that can accommodate the collection box 31 is provided at the center, with respect to the horizontal direction D3 (width direction), of the support holder 32. In a state in which the cover 35 is attached to the support holder 32, the housing portion 322, together with the cover 35, forms a recessed housing space extending in the vertical direction D1. The collection box 31 is attached removably to the housing portion 322, and is accommodated in the recessed housing space of the housing portion 322 when it is attached to the housing portion 322.

As shown in FIG. 4, two intake ports 37 are exposed in the support holder 32 when the collection box 31 is removed. The two intake ports 37 are through holes formed in the base portion 321, and functions as inlets of the intake fans 151 included in the intake unit 15, which will be described later. The two intake ports 37 are spaced apart from each other in the width direction D3 by a predetermined distance. In the present embodiment or embodiments or embodiments, when the collection box 31 is attached to the housing portion 322, two discharge ports (not illustrated) provided in a side face (front face) on the forward side of the collection box 31 are connected to the intake ports 37. Accordingly, the intake unit 15 and the collection box 31 are connected such that air can be suctioned in from the collection box 31.

As shown in FIG. 3, the intake nozzle 33 is provided in a lower portion of the support holder 32. Also, the extension nozzle 34 is provided in a side portion of the support holder 32.

As shown in FIG. 3 and FIG. 4, the extension nozzle 34 is provided on the left of the support holder 32, when the cleaning apparatus 10 is viewed from the front. The housing space 38 is provided on the left of the support holder 32, and the extension nozzle 34 can be housed in the housing space 38. The extension nozzle 34 is supported by the support holder 32 and is turnable. Specifically, the extension nozzle 34 is supported by the support holder 32 such that its orientation can be changed between a housed orientation (orientation shown in FIG. 3 and FIG. 4) in which the extension nozzle 34 is housed in the housing space 38 and a side cleaning orientation (not illustrated) that is achieved by turning the extension nozzle 34 leftward from the housing space 38 and in which the floor surface 23 on the left of the apparatus body 11 can be cleaned.

As shown in FIG. 5, the support holder 32 is provided on the back face side of the cleaning apparatus 10. A plate-shaped back face frame 11C that extends upward from the rear end portion of the chassis 11B is provided inside the apparatus body 11. The support holder 32 is attached to the back face frame 11C. In the present embodiment or embodiments or embodiments, the support holder 32 is supported by the back face frame 11C of the apparatus body 11 and is movable in the vertical direction D1 by the sliding mechanism 50 (see FIG. 2). Accordingly, the cleaning unit 30 itself can be moved in the vertical direction D1.

The sliding mechanism 50 supports the support holder 32 so that it is movable in the vertical direction D1, and is provided in or at the apparatus body 11, as shown in FIG. 2. The sliding mechanism 50 includes a pair of slide rails that are spaced apart from each other in the width direction D3, in the back face frame 11C of the apparatus body 11. The slide rails can be known slide members including an outer member and an inner member. The outer member is attached to a face on the rear side of the back face frame 11C, and the inner member is attached to a face 321A on the forward side of the base portion 321, for example. The cleaning unit 30 is supported by the sliding mechanism 50 so that it is slidable in the vertical direction D1 along with the support holder 32.

Note that the slide support mechanism of the cleaning unit 30 is not limited to the aforementioned slide rails. A support mechanism having any configuration can be adopted as long as the support mechanism supports the cleaning unit 30 so that it is movable in the vertical direction D1.

The support holder 32 includes a plate-shaped base portion 321 extending in the vertical direction D1. The housing portion 322 is integrally formed in the base portion 321.

The base portion 321 is formed by a sheet metal, and is attached to the back face frame 11C (see FIG. 2) via the sliding mechanism 50 (see FIG. 2). The housing portion 322 is provided on a face 321A on the rear side of the base portion 321, and is arranged at the center, with respect to the width direction D3, of the base portion 321. The housing portion 322 includes a pair of side plates 322A and a retaining board 322B. The two side plates 322A are spaced apart from each other in the width direction D3 by a predetermined distance. The retaining board 322B, which extends in the width direction D3, is attached to the rear end portions of the lower portions of the side plates 322A. Also, a bottom plate 324 that forms an upper face of the intake nozzle 33 is provided in a lower portion of the base portion 321. The collection box 31 is housed in a housing space that is surrounded by the pair of side plates 322A, the retaining board 322B, and the bottom plate 324.

Figure 6A:
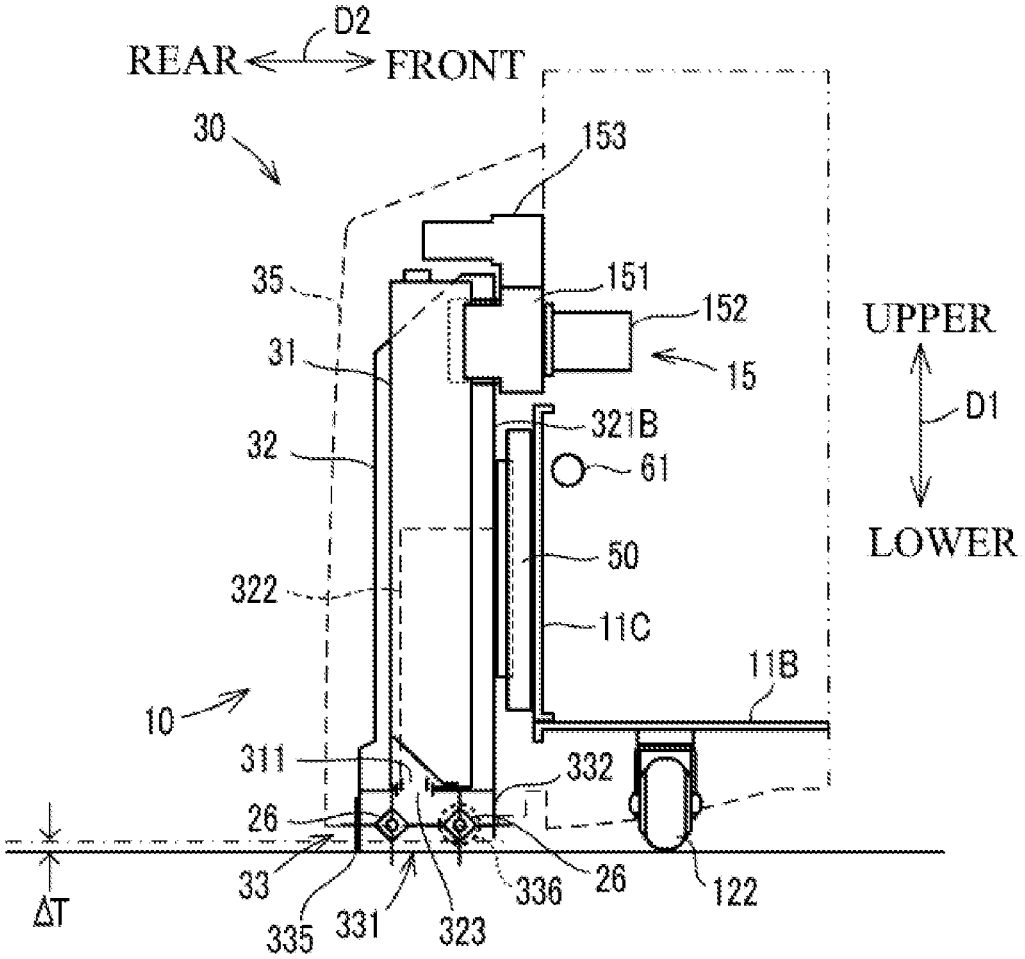
FIG. 6A and FIG. 6B are diagrams illustrating side views of a rear portion of a cleaning apparatus.
Figure 6B:
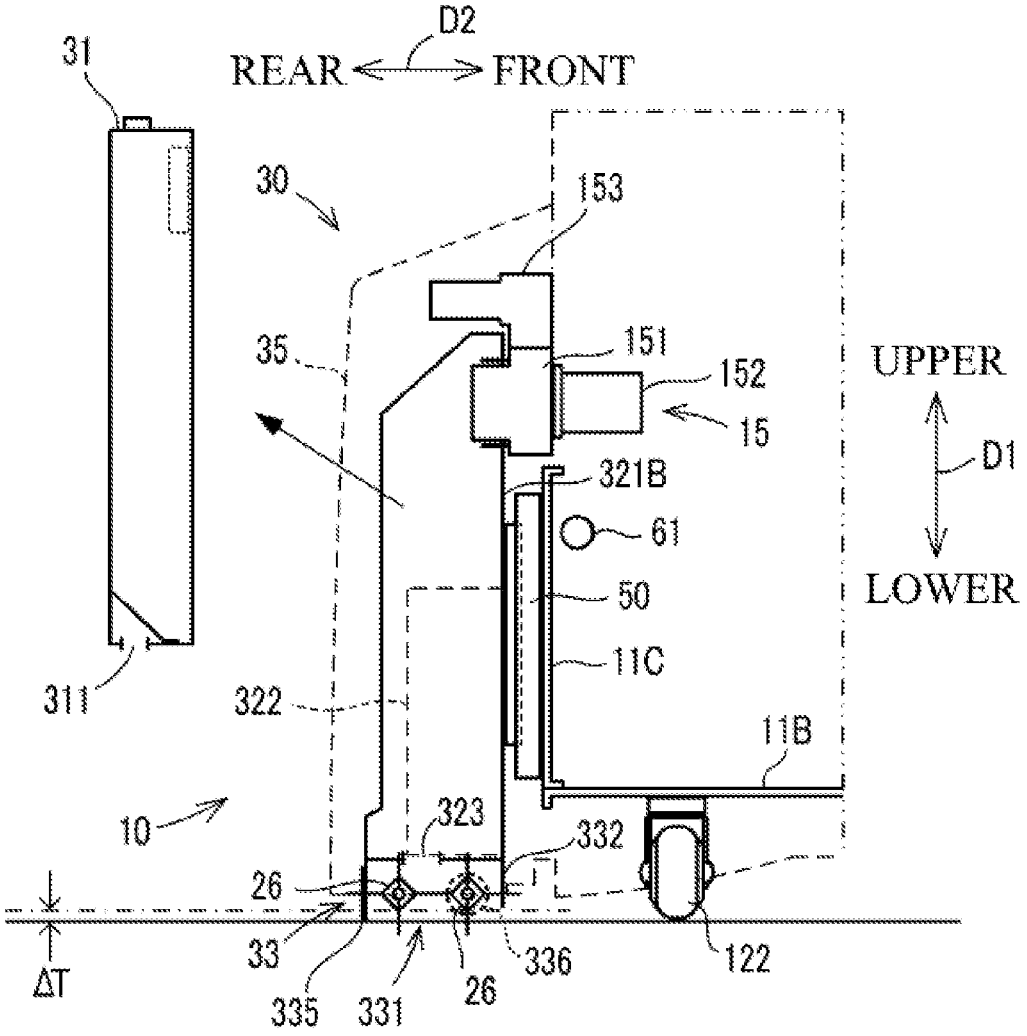

The rear side of the housing portion 322 is open in a state in which the cover 35 is attached, and the upper side is also open (see FIG. 4). Therefore, as shown in FIG. 6A and FIG. 6B, the collection box 31 can be attached to or removed from the housing portion 322 from or to a region obliquely upward and rearward of the housing portion 322. Here, FIG. 6A and FIG. 6B are side views of the rear portion of the cleaning apparatus 10, FIG. 6A shows a state in which the collection box 31 is housed in the housing portion 322, and FIG. 6B shows a state in which the collection box 31 is removed from the housing portion 322.

The intake unit 15 is provided in an upper portion of the cleaning unit 30, and specifically, is attached to the base portion 321 of the support holder 32. The intake unit 15 is for generating a suction force with which air is suctioned in through an intake nozzle 33 of the cleaning unit 30, and waste matters such as dust (objects to be suctioned in) on the floor surface 23 are suctioned in through the intake nozzle 33 along with air. The intake unit 15 includes the intake fans 151, the motors 152 that rotate the intake fans 151, and ducts 153. When the intake fans 151 rotate driven by the motors 152, air is suctioned in through the intake ports 37, and the air is conveyed to a space in an upper portion of the cleaning unit 30 through the ducts 153.

An air filter for capturing and removing waste matters such as dust from the air discharged from the outlet is provided inside the collection box 31. As a result, clean air is obtained. A chemical filter, a HEPA filter, an ULPA filter, or the like can be used as the air filter.

Note that a rectangular opening 323 elongated in the width direction D3 is formed in a bottom face of the housing portion 322. The opening 323 is in communication with the intake nozzle 33, which will be described later. In a state in which the collection box 31 is attached to the housing portion 322, an inlet 311 provided in a bottom face of the collection box 31 is aligned to the opening 323. Accordingly, the intake nozzle 33 is brought into communication with the collection box 31. When air is suctioned in by driving the intake fans 151, the pressure inside the collection box 31 decreases, and as a result, the dust that is suctioned up through the intake nozzle 33 along with air flows into the collection box 31 through the inlet 311, and is collected in the collection box 31.

Intake Nozzle 33

The intake nozzle 33 is a portion for suctioning up waste matters such as dust from the floor surface 23 along with air when the intake fans 151 operate. As shown in FIG. 6A and FIG. 6B, the intake nozzle 33 includes a suction port 331 at a position separated from the floor surface 23 upward by a gap ΔT. That is, the suction port 331 is arranged at a position separated from the floor surface 23 upward by a gap ΔT. The intake nozzle 33 is provided in a lower end portion of the support holder 32. In the present embodiment or embodiments, the intake nozzle 33 is integrally formed with the support holder 32.

The intake nozzle 33 extends in the width direction D3, and is constituted by a rectangular tube-shaped outer circumferential wall 332 that protrude downward from an outer circumferential portion of a bottom plate 324 of the base portion 321. The outer circumferential wall 332 is open on the downward side, and forms the aforementioned suction port 331.

An elastic sheet-like seal member 335 that extends toward the floor surface 23 is provided on an edge portion on the rear side of the suction port 331 of the intake nozzle 33. The seal member 335 is rectangular and elongated in the width direction D3, and is joined to the entire edge of the suction port 331 in the width direction D3. The gap ΔT between the edge portion on the rear side of the suction port 331 and the floor surface 23 is closed by the seal member 335.

A pair of rotary brushes 26 are rotatably provided in the intake nozzle 33. The rotary brushes 26 are arranged side by side in the front-back direction D2. The rotating shafts of the rotary brushes 26 are rotatably supported by side plates 334 (see FIG. 5) at both ends, in the width direction D3, of the intake nozzle 33. When a driving force from a motor (not illustrated) is input to the rotary brushes 26 via a transmission mechanism 39 such as belts and pulleys (see FIG. 5), the rotary brushes 26 rotate, and waste matters on the floor surface 23 can be collected well.

Rotating rollers 336 (an example of a rotator of one or more embodiments) are rotatably supported by the rotating shaft of the rotary brush 26 located on the forward side. The rotating rollers 336 are attached to the respective ends of the rotating shaft of the rotary brush 26.

The rotating rollers 336 are provided such that their outer circumferential surfaces are located between a circumferential edge portion of the suction port 331 (that is, a lower end portion of the intake nozzle 33) and the floor surface 23. That is, when the cleaning apparatus 10 is in the moving posture shown in FIG. 1, the outer circumferential surfaces of the rotating rollers 336 protrude downward from the lower end portion of the intake nozzle 33, but are not in contact with the floor surface 23.

As a result of these rotating rollers 336 being provided in the support holder 32, when there is a level difference or the like in the floor surface 23 to be cleaned, the rotating rollers 336 come into contact with a protrusion or the like when the cleaning apparatus 10 is moving autonomously. When the rotating rollers 336 come into contact with the level difference, an upward external force is applied to the rotating rollers 336. As a result of receiving the external force, the support holder 32 is lifted up, and the cleaning unit 30 moves upward. That is, the cleaning unit 30 moves upward from a cleaning position at the time of performing cleaning (an example of a limit position of one or more embodiments), and the intake nozzle 33 is retracted upward from the cleaning position. As a result, the intake nozzle 33 is prevented from coming into contact with the level difference, and a damage, abnormal turning, toppling over, or the like that is caused by the contact between the intake nozzle 33 and the level difference can be prevented from occurring. Note that when the cleaning apparatus 10 has passed over the level difference, the cleaning unit 30 is returned to the original position, and is again supported at the cleaning position.

In the present embodiment or embodiments, the cleaning unit 30 is supported by the position adjustment mechanism 60, which will be described later, at a later-described cleaning position (position shown in FIG. 6A), and the cleaning position of the cleaning unit 30 can be adjusted in the vertical direction D1 by the position adjustment mechanism 60. Here, the cleaning position is a position at which the suction port 331 is separated from the floor surface 23 upward by a gap ΔT, and is also a position at which the floor surface 23 can be cleaned when the cleaning apparatus 10 moves. The gap ΔT is determined within a setting range (cleaning position adjustable range) of about 5 mm to 10 mm, for example, and the gap ΔT can be adjusted by the later-described position adjustment mechanism 60. As a result of the gap ΔT being adjusted in the cleaning position adjustable range, the intake force (air suction force) of the intake nozzle 33 and the pressing force of the rotary brushes 26 exerted toward the floor surface 23 are appropriately adjusted in accordance with the state of the floor surface 23. Note that the gap ΔT is a length at which the cleaning apparatus 10 can clean the floor surface 23, and is set to an appropriate length in accordance with the suction force of the cleaning unit 30 and the state of the floor surface 23, and the adjustable range thereof is not limited to the above-described setting range.

Figure 7:
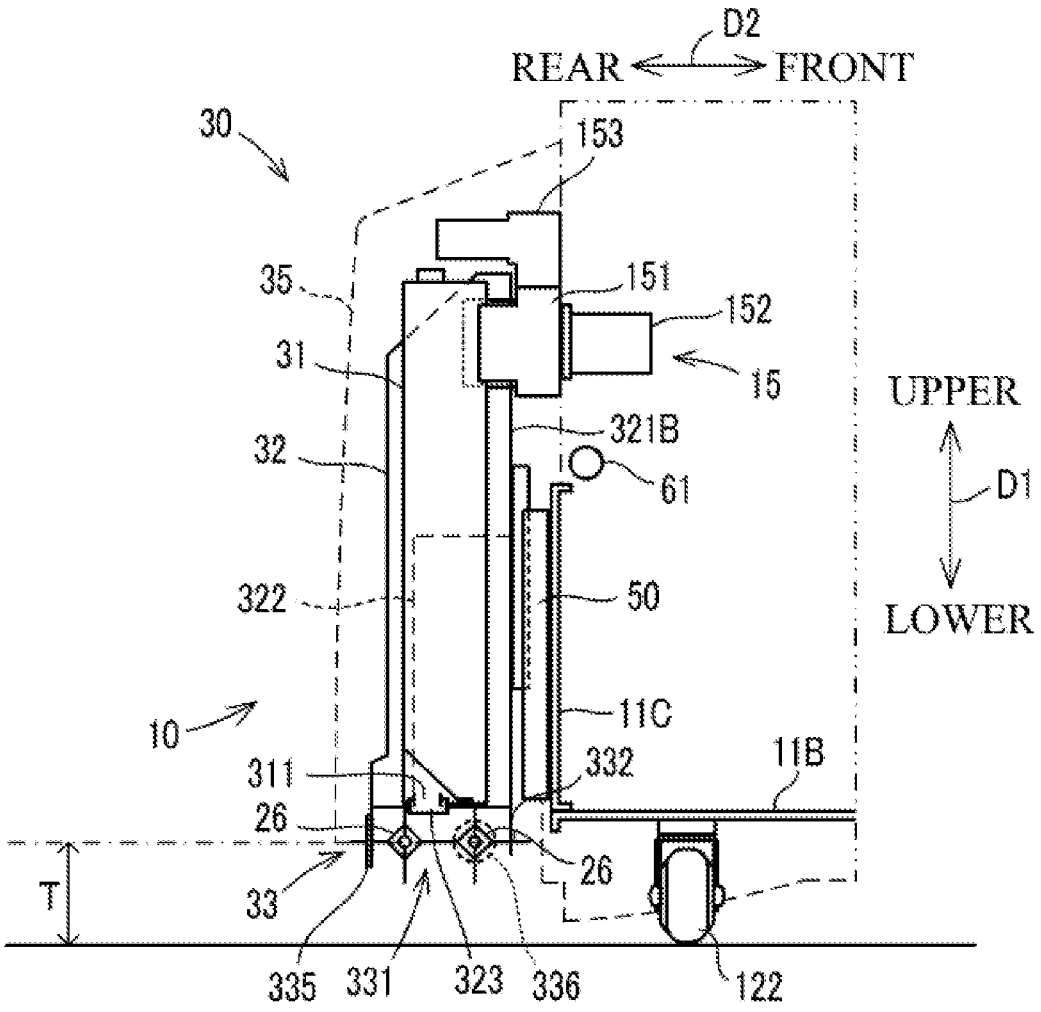
FIG. 7 is a diagram illustrating a state in which a support holder is located at a retreat position.

Also, as shown in FIG. 7, the position adjustment mechanism 60 can also adjust the height position of the cleaning unit 30 to a retreat position higher than the upper limit position of the cleaning position adjustable range. Here, FIG. 7 illustrates a state in which the cleaning unit 30 is located at the retreat position. The retreat position is a position that is determined to a position higher than the upper limit position such that the intake nozzle 33 will not collide with a level difference on the floor surface 23 when the cleaning apparatus 10 is caused to move without performing a cleaning task, for example. For example, the retreat position is a position at which the distance in height T from the floor surface 23 to the suction port 331 is about 20 mm, for example. Note that the level difference is a portion that protrudes from the floor surface 23, and may be a member that is set on the floor such as a braille block, a wiring cover, a floor plate for covering an underfloor inspection hole, a floor outlet, or a floor mat that is set on the floor surface 23. Of course, the length of the distance in height T is not limited to the above-described length, and can be determined to an appropriate length depending on the height of the level difference.

Position Adjustment Mechanism 60

Figure 8:
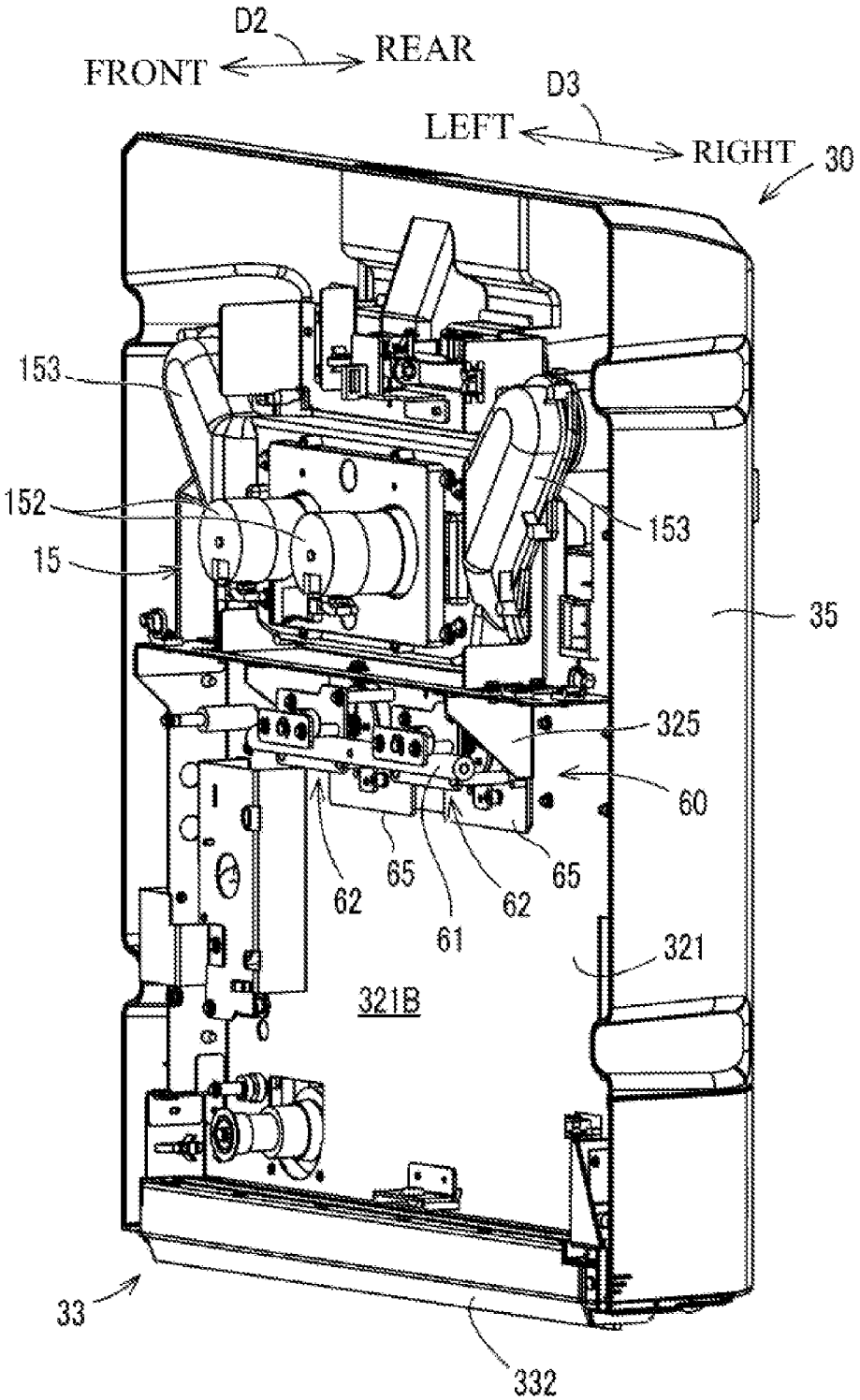
FIG. 8 is a diagram illustrating a perspective view of a cleaning unit when viewed from a front, and shows an internal configuration of a cleaning unit.
Figure 9:
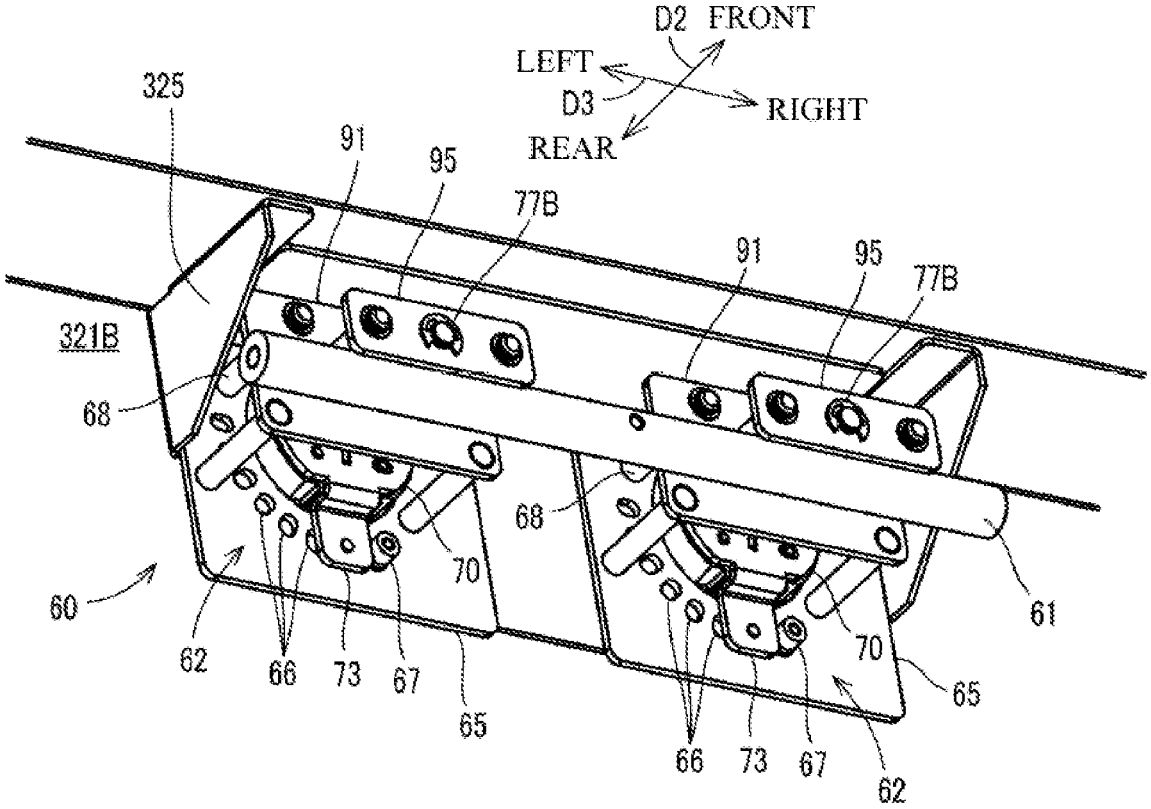
FIG. 9 is a diagram illustrating a partial enlarged view of a position adjustment mechanism provided in a cleaning apparatus.
Figure 10:
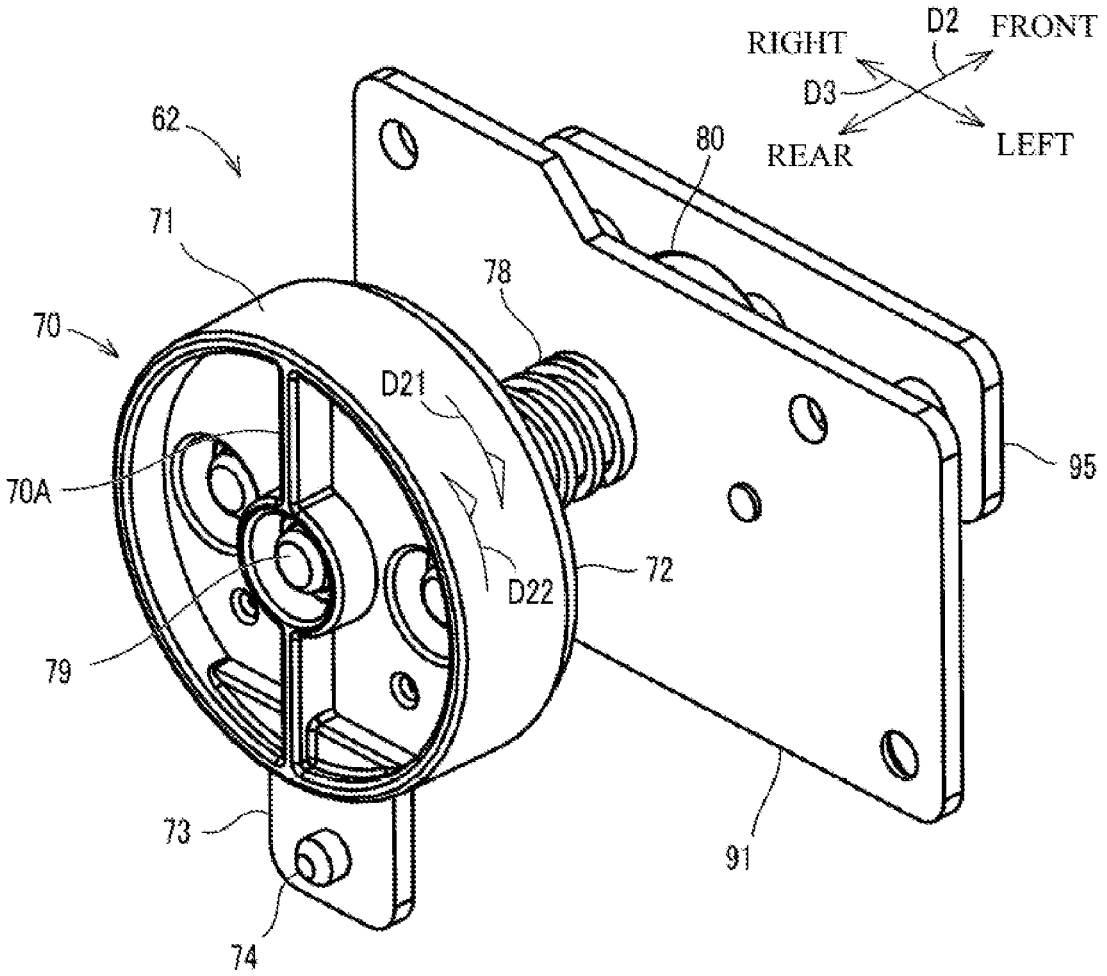
FIG. 10 is a diagram illustrating a perspective view of a configuration of a dial unit of a position adjustment mechanism.
Figure 11:
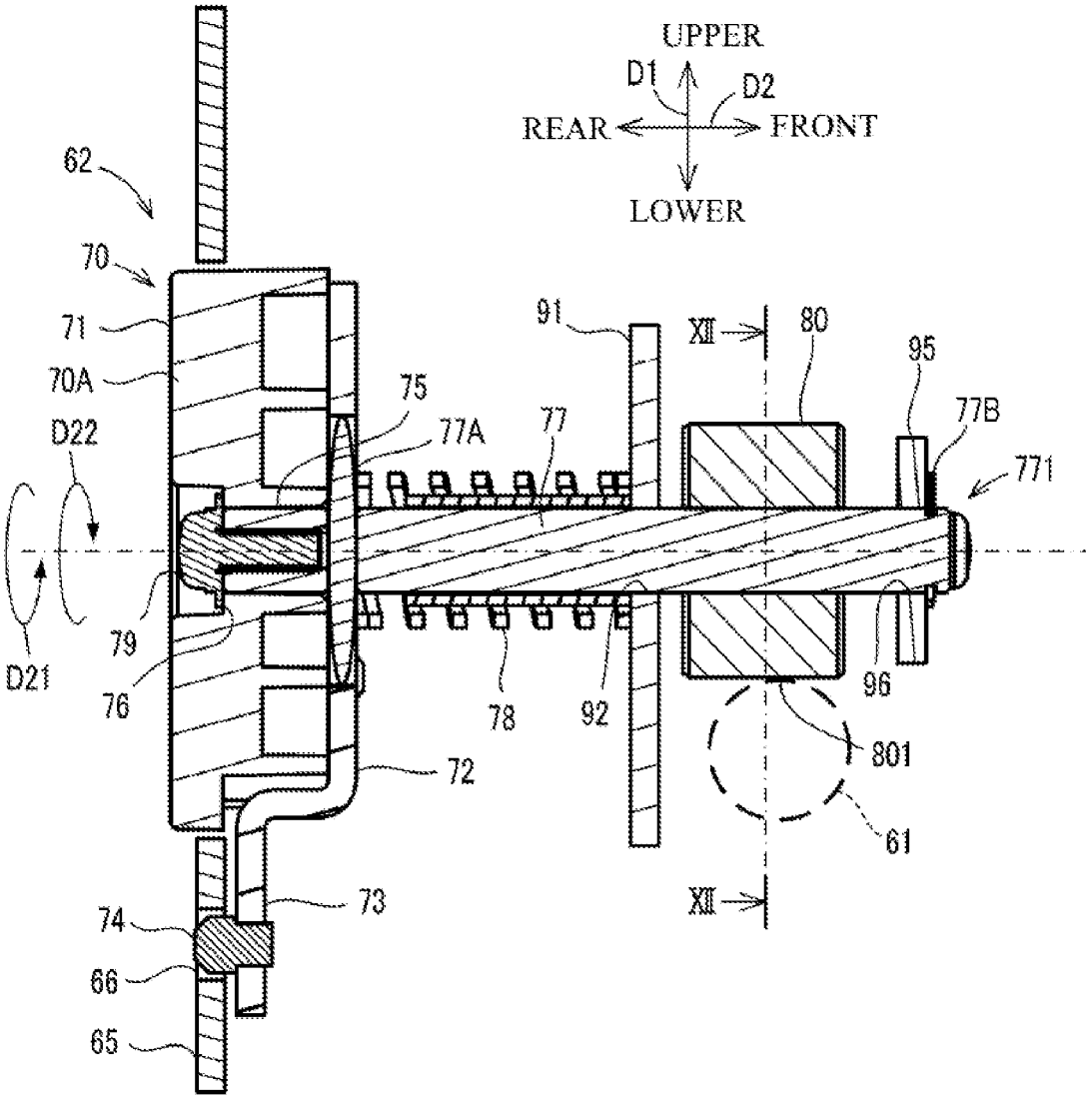
FIG. 11 is a diagram illustrating a cross-sectional view of a dial unit, and illustrating a state in which a rotating cam is located at a first position.
Figure 12:
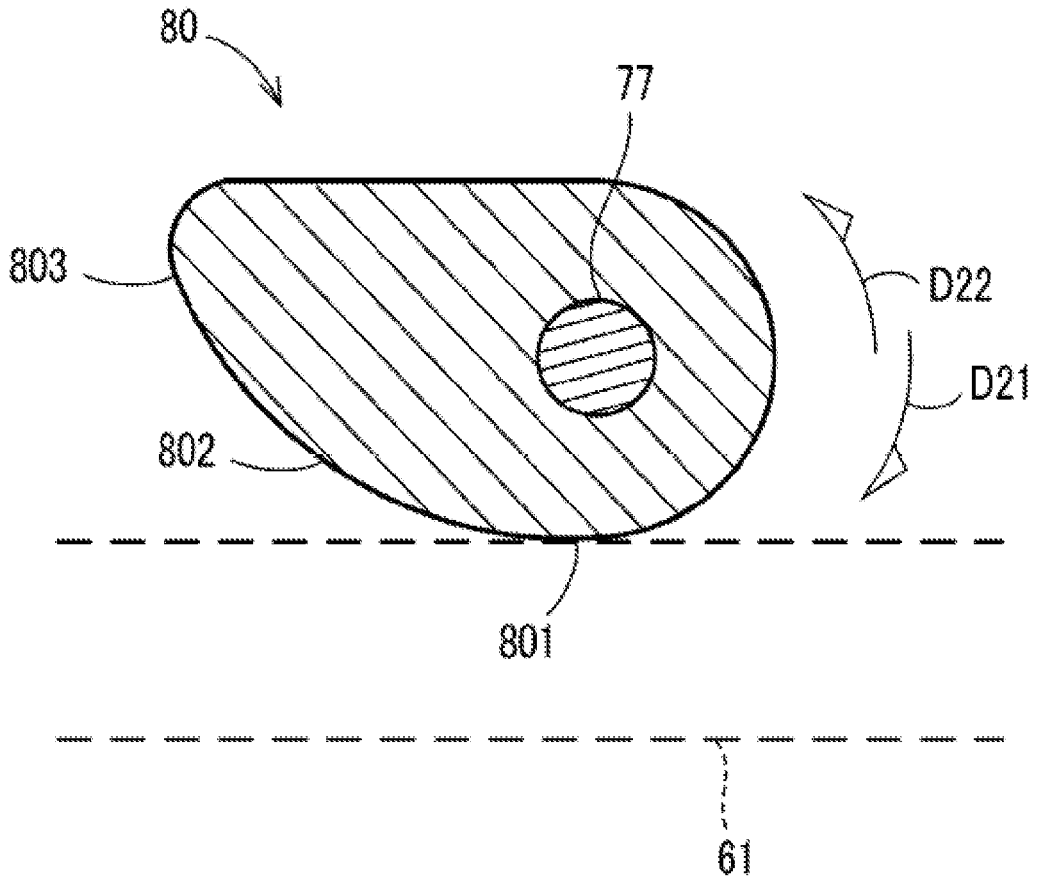
FIG. 12 is a diagram illustrating a cross-sectional view taken along a cross-sectional face XII-XII shown in FIG. 11, and illustrating a cross-sectional shape of a rotating cam.
Figure 13:
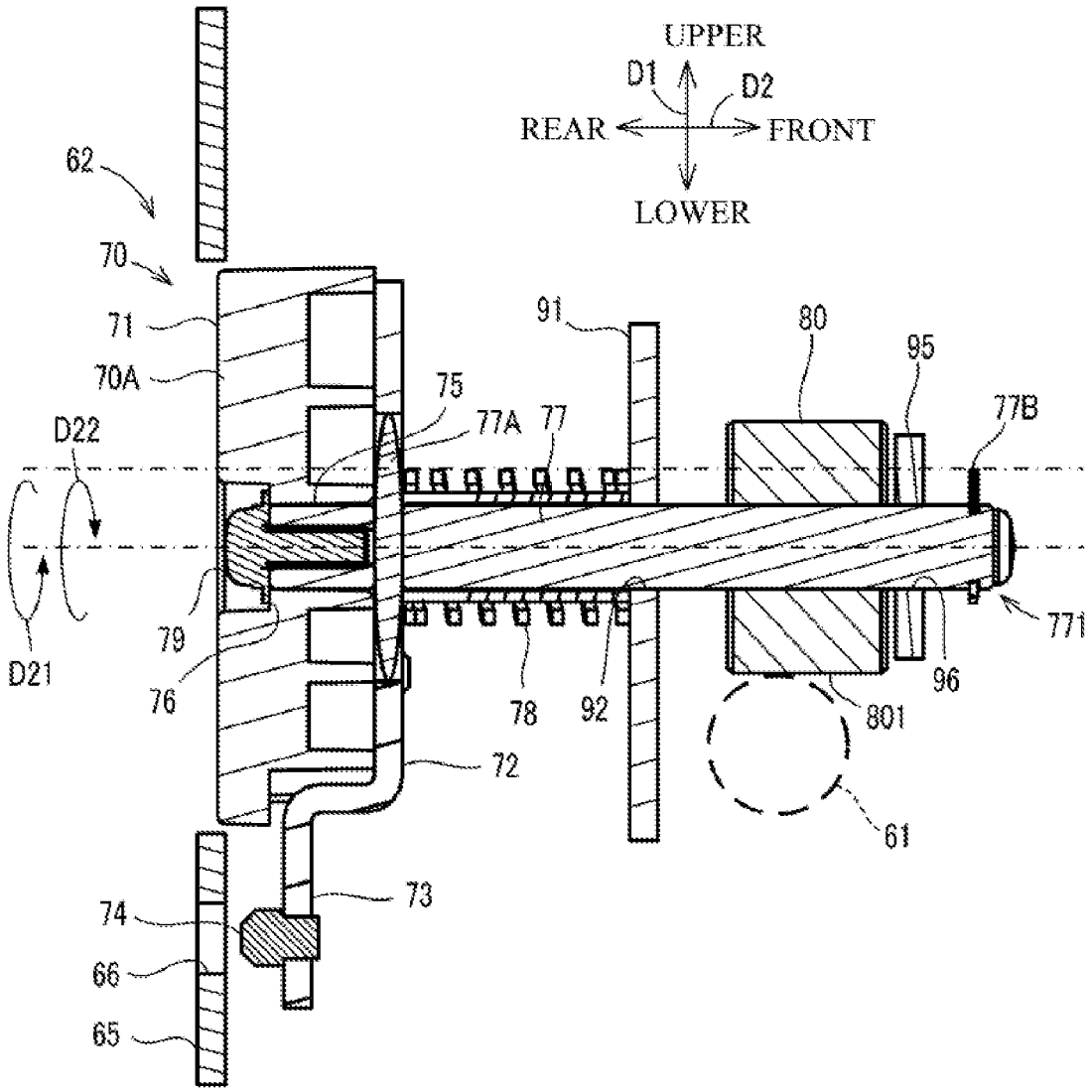
Figure 14:
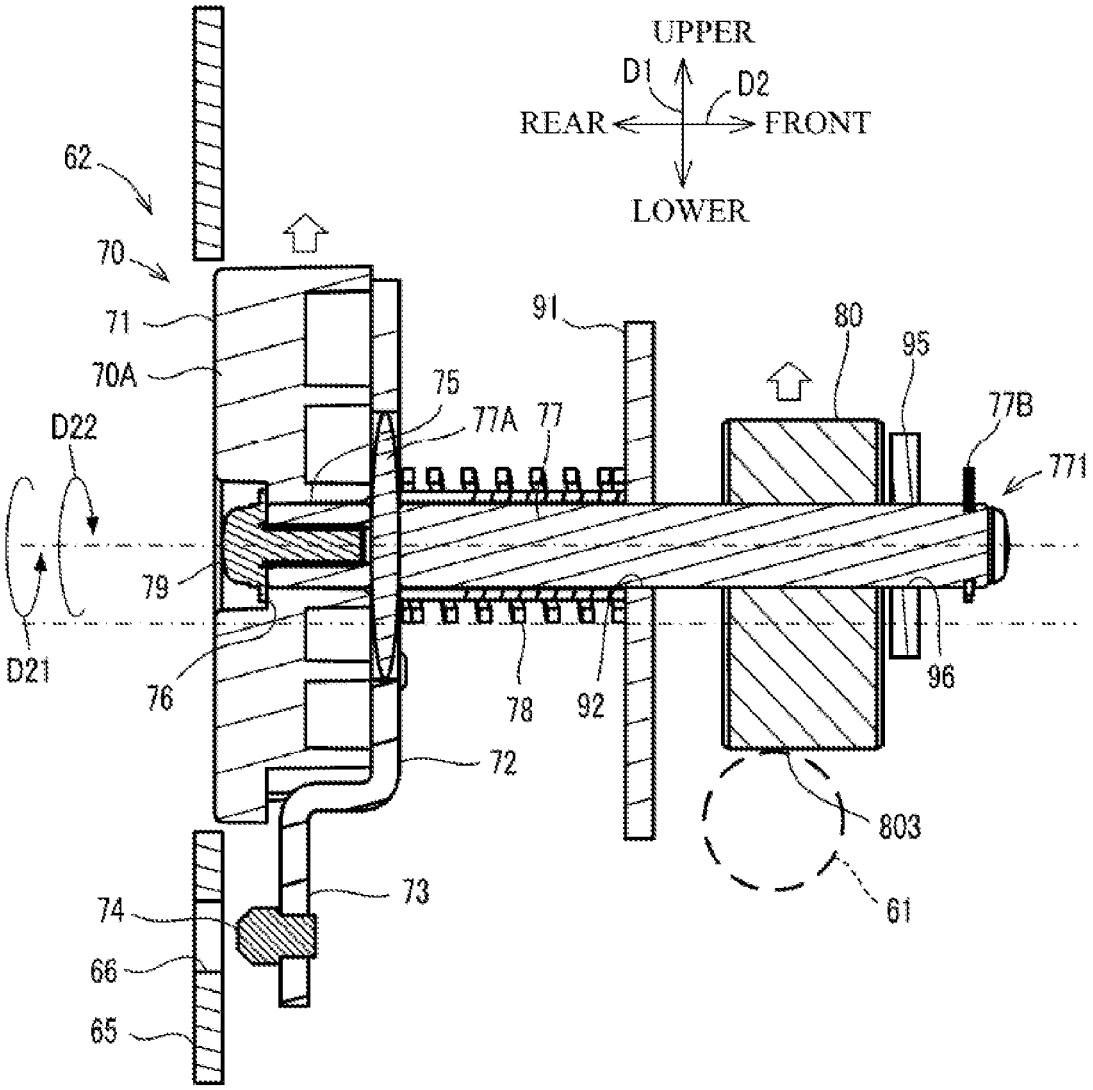
FIG. 14 is a diagram illustrating a cross-sectional view of a dial unit, and illustrating a state in which a rotating cam is located at a second position.

Hereinafter, the position adjustment mechanism 60 will be described with reference to FIG. 8 to FIG. 12. FIG. 8 is a perspective view of the cleaning unit 30 when viewed from the front. FIG. 9 is a partial enlarged view illustrating the position adjustment mechanism 60. FIG. 10 is a perspective view illustrating a configuration of a dial unit 62 of the position adjustment mechanism 60. FIG. 11 is a cross-sectional view of the dial unit 62. FIG. 12 is a cross-sectional view of a rotating cam 80 of the position adjustment mechanism 60. FIG. 13 is a cross-sectional view illustrating a state in which the lock of the adjustment dial 70 is released. FIG. 14 is a cross-sectional view illustrating a state in which the position, in a rotation direction, of the adjustment dial 70 is again locked after the position has been adjusted.

As shown in FIG. 8 and FIG. 9, the position adjustment mechanism 60 can be broadly separated into a support shaft 61 (an example of a positioning member of one or more embodiments) provided in the apparatus body 11 and a dial unit 62 provided in the cleaning unit 30. Note that the support shaft 61 is shown in FIG. 8 for the sake of illustration, but the support shaft 61 is not actually provided in the cleaning unit 30, but is a member provided in the apparatus body 11.

The support shaft 61 is a member for positioning the cleaning unit 30 to the cleaning position. Downward movement of the cleaning unit 30 from the cleaning position is restricted by the engagement with the support shaft 61.

The support shaft 61 is a horizontal shaft member that extends in the width direction D3, and is fixed to a support frame or the like of the apparatus body 11. The support shaft 61 is formed by a round steel barf, for example. The support shaft 61 is arranged on the rear side of the apparatus body 11, and the rotating cam 80 included in the dial unit 62 is supported by its upper face. As a result of the rotating cam 80 being supported by the upper face of the support shaft 61, the cleaning unit 30 supported by the sliding mechanism 50 is positioned in the cleaning position.

Note that, in the present embodiment or embodiments, description will be given taking the support shaft 61 as an example of the positioning member of the cleaning unit 30, but a member formed by a horizontal steel plate that extends in the width direction D3 may also be used in place of the support shaft 61. A member having any configuration can be adopted as the positioning member of the cleaning unit 30 as long as the member can support the rotating cam 80 on its upper face, and restrict downward movement of the cleaning unit 30 from the cleaning position.

As shown in FIG. 9, the cleaning unit 30 is provided with two dial units 62. The two dial units 62 are attached to a face 321B on the forward side of the base portion 321 of the support holder 32. A bracket 325 for supporting the two dial units 62 is fixed to the face 321B, and the two dial units 62, which are arranged side by side in the horizontal direction, are attached to the bracket 325.

As shown in FIG. 9 to FIG. 11, the dial units 62 each include a lock plate 65 (an example of a fixing plate of one or more embodiments, see FIG. 9), an adjustment dial 70 (an example of an operation input unit of one or more embodiments), a shaft 77, a coil spring 78 (an example of an elastic member of one or more embodiments), a rotating cam 80 (an example of a cam member of one or more embodiments), a spring fixing plate 91, and a shaft restricting plate 95.

As shown in FIG. 9, in one dial unit 62, the lock plate 65 is a rectangular plate member, and is fixed to the bracket 325. The lock plate 65 is proved with a plurality of engagement holes 66 into which a later-described lock pin 74 is inserted in order to lock the position of the adjustment dial 70 in the rotation direction. The engagement holes 66 are arranged at equal angle intervals along the rotation direction of the adjustment dial 70.

The lock plate 65 is provided with stoppers 67, 68 for restricting the rotational position of the adjustment dial 70. As a result of a projection piece 73 of the adjustment dial 70 coming into contact with the stopper 67, rotation of the adjustment dial 70 in a later-described lowering direction D21 is restricted. Hereinafter, the position of the adjustment dial 70 (position shown in FIG. 9) at which the projection piece 73 comes into contact with the stopper 67 and rotation of the adjustment dial 70 is restricted is referred to as the first limit position. Also, as a result of the projection piece 73 of the adjustment dial 70 coming into contact with the stopper 68, rotation of the adjustment dial 70 in a later-described rising direction D22 is restricted. Hereinafter, the position of the adjustment dial 70 at which the projection piece 73 coming into contact with the stopper 68 and rotation of the adjustment dial 70 is restricted is referred to as the second limit position.

In the present embodiment or embodiments, when the adjustment dial 70 is rotated to the first limit position, the height position of the cleaning units 30 is adjusted to a lower limit position that is lowest in the cleaning position adjustable range (at which the gap $\Delta T$ is smallest). Also, when the adjustment dial 70 is rotated in the rising direction D22 from the first limit position, the height position of the cleaning unit 30 slowly moves upward from the lower limit position, and reaches an upper limit position that is highest in the cleaning position adjustable range. Then, when the adjustment dial 70 is further rotated in the rising direction D22 and reaches the second limit position, the height position of the cleaning unit 30 exceeds the upper limit position in the cleaning position adjustable range, and moves upward to the retreat position.

The adjustment dial 70 is rotatably supported by the face 321A on the rear side of the base portion 321. The adjustment dial 70 includes a thin cylindrical dial body 71 in which an operation knob 70A is provided on its top surface, a lock member 72 attached to the dial body 71 on its forward side, and a shaft 77. The shaft 77 is a rotating shaft of the adjustment dial 70.

The shaft 77 is attached to the dial body 71. A through hole 75 is formed at the center of the dial body 71, and a recessed receiving portion 76 that is concentric with the through hole 75 and whose outer diameter is larger than the through hole 75 is formed in a side face on the rear side of the dial body 71. Also, a through hole for passing the shaft 77 is formed in the lock member 72. Also, a hook 77A is fixed to the shaft 77 on the forward side of the dial body 71. A threaded hole is formed in a rear end portion on the rear side of the shaft 77. A screw 79 is screwed to the threaded hole in a state in which the shaft 77 is inserted to the through hole 75, and as a result, the shaft 77 is fixed to the dial body 71 and the lock member 72 by the hook 77A and a washer of the screw 79.

A spring fixing plate 91 is arranged at a position separated forward from the lock plate 65. The spring fixing plate 91 is fixed to the lock plate 65 by a spacer, a screw, and the like in a state in which it is separated forward from the lock plate 65 by a predetermined distance. Also, a shaft restricting plate 95 is arranged at a position separated forward from the spring fixing plate 91. The shaft restricting plate 95 is fixed to the spring fixing plate 91 by a spacer, a screw, and the like in a state in which it is separated forward from the spring fixing plate 91.

A through hole 92 is formed in the spring fixing plate 91, and a through hole 96 is also formed in the shaft restricting plate 95. The shaft 77 is inserted in these through holes 92, 96. Accordingly, the adjustment dial 70 is rotatably supported.

As shown in FIG. 11, in order for the shaft 77 not to pass rearward through the through hole 96, a hook 77B is attached to a leading end portion 771 on the forward side of the shaft 77. The hook 77B prevents the shaft 77 from passing rearward through the through hole 96.

The rotating cam 80 is fixed to the shaft 77. The rotating cam 80 is arranged between the spring fixing plate 91 and the shaft restricting plate 95.

FIG. 12 is a cross-sectional view taken along a cross-sectional face XII-XII shown in FIG. 11, and illustrates a cross-sectional shape of the rotating cam 80. The rotating cam 80 is a cam member that includes a cam face 801 at which the lift amount from the shaft 77 to an outer circumferential surface is smallest, and a cam face 803 at which the lift amount is largest. A face 802 that extends from the cam face 801 to the cam face 803 is a curved cam face 802 that is formed such that the lift amount gradually increases. When the adjustment dial 70 is located at the first limit position, the cam face 801 comes into contact with the support shaft 61, and is supported thereon. Also, when the adjustment dial 70 is located at the second limit position, the cam face 803 comes into contact with the support shaft 61, and is supported thereon.

The adjustment dial 70 is an operation member to be operated by a worker. When the adjustment dial 70 is rotated in the lowering direction D21 or the rising direction D22 shown in FIG. 10, the rotating cam 80 rotates in the same direction. That is, the adjustment dial 70 is an operation member for applying a force in a rotating direction of the rotating cam 80 to the rotating cam 80. When the adjustment dial 70 is rotated in the rising direction D22 in a state in which the adjustment dial 70 is located at the first position, the rotating cam 80 rotates in the rising direction D22, and the height position of the cleaning unit 30 can be changed to the retreat position that is higher than the cleaning position.

In the present embodiment or embodiments, the lowering direction D21 is a direction in which the adjustment dial 70 rotates in a clockwise direction, in FIG. 10, and the rising direction D22 is a direction in which the adjustment dial 70 rotates in a counterclockwise direction.

As shown in FIG. 11, the lock member 72 includes a projection piece 73 that projects from an outer circumferential surface of the dial body 71 in a radial outward direction. The projection piece 73 rotates in the lowering direction D21 when the adjustment dial 70 is rotated in the lowering direction D21, and rotates in the rising direction D22 when the adjustment dial 70 is rotated in the rising direction D22.

The projection piece 73 is provided with a lock pin 74 (an example of a protrusion of one or more embodiments that projects rearward from its face on the rear side. The fixing mechanism of one or more embodiments is realized by the lock pin 74 and a plurality of lock engagement holes 66. The lock pin 74 is inserted into one of a plurality of engagement holes 66 formed in the lock plate 65, and engages therewith. Accordingly, the adjustment dial 70 is prevented from rotating, and the adjustment dial 70 is locked (fixed) at a position in the rotation direction, which is determined by the position of the engagement hole 66 into which the lock pin 74 has been inserted. As a result of the adjustment dial 70 being locked, the later-described rotating cam 80 that is fixed to the shaft 77 is also locked (fixed) at a position in the rotation direction. Note that, in a state in which the adjustment dial 70 is located at the first limit position or the second limit position, the lock pin 74 is inserted into an engagement hole 66 corresponding to the limit position.

A plurality of tick marks are drawn on the face 321A of the base portion 321 at positions corresponding to the plurality of engagement holes 66. The tick marks are drawn at equal angle intervals in a circumferential direction along the rotation direction of the adjustment dial 70.

As shown in FIG. 11, the shaft 77 is provided with a coil spring 78. The coil spring 78 is provided between the lock member 72 and the spring fixing plate 91 in a state in which the shaft 77 is inserted into an inner hole of the coil spring 78. The coil spring 78 is a so-called compression spring, and is provided between the lock member 72 and the spring fixing plate 91 in a compressed state in order to generate a predetermined spring force. Accordingly, the coil spring 78 continuously applies a rearward force to the lock member 72 when an external force is not applied. As a result of receiving the rearward force, the lock member 72 keeps the state in which the lock pin 74 is inserted into one of the engagement holes 66. That is, the positions of the adjustment dial 70 and the rotating cam 80 are maintained.

For example, when the adjustment dial 70 is pushed forward when the adjustment dial 70 is located at the first limit position, the coil spring 78 is compressed, and the dial body 71 moves forward. Accordingly, the lock pin 74 is drawn out from the engagement hole 66, as shown in FIG. 13, and as a result, the locking between the adjustment dial 70 and the rotating cam 80 is canceled. When the adjustment dial 70 is rotated in the rising direction D22, and is rotated until the second limit position at which the projection piece 73 comes into contact with the stopper 68, the rotating cam 80 rotates to a position at which the cam face 803 whose lift amount is largest opposes the support shaft 61 (see FIG. 14). Here, the cleaning unit 30 moves upward to the retreat position. When the adjustment dial 70 is returned to the original position with the cleaning unit 30 in an upward state, the lock pin 74 is inserted into one engagement hole 66, and the adjustment dial 70 and the rotating cam 80 are fixed. The cleaning unit 30 is also kept at the retreat position.

Also, when the adjustment dial 70 is pushed forward when the adjustment dial 70 is located at the second limit position, and is rotated in the lowering direction D21 until the first limit position at which the projection piece 73 comes into contact with the stopper 67, the rotating cam 80 rotates to a position at which the cam face 801 whose lift amount is smallest opposes the support shaft 61. Here, the cleaning unit 30 moves downward to the lower limit position in the cleaning position adjustable range. When the adjustment dial 70 is returned to the original position with cleaning unit 30 in the lowered state, the lock pin 74 is inserted into one engagement hole 66, and the adjustment dial 70 and the rotating cam 80 are fixed. The cleaning unit 30 is also kept at the lower limit position.

Note that the apparatus body 11 may also be provided with an elastic member that applies an upward force to the support holder 32. The upward force (spring force) of the elastic member is a spring force that is smaller than the downward force (in the gravity direction) due to the total weight of the cleaning unit 30. Accordingly, when a position adjustment operation is performed using the position adjustment mechanism 60, the upward movement of the cleaning unit 30 can be supported by the upward force of the elastic member, and the cleaning unit 30 can be smoothly moved upward with a small operation force.

As described above, in the present embodiment or embodiments or embodiments, the cleaning apparatus 10 is provided with the position adjustment mechanism 60, and therefore, when cleaning is performed by the cleaning apparatus 10, even in a case where there is a level difference in the floor surface 28, which is the surface to be cleaned, the cleaning unit 30 is moved upward from the limit position by an upward force generated due to the intake nozzle 33 coming into contact with the level difference. Accordingly, a forceful collision between the intake nozzle 33 and the level difference can be avoided, and the damage of the intake nozzle 33 can be prevented. Also, when the cleaning apparatus 10 is caused to move without performing cleaning, the limit position can be changed to an upward position such that the intake nozzle 33 will not come into contact with the level difference. Accordingly, the intake nozzle 33 will not come into contact with the level difference when the cleaning apparatus 10 moves without performing cleaning, and therefore the movement at the time of not performing cleaning is not hampered by the level difference, and smooth movement can be realized.

Also, the rotating rollers 336 are provided in the cleaning unit 30, and therefore the rotating rollers 336 come into contact with a level difference before the intake nozzle 33 coming into contact with the level difference, and pass over the level difference. Here, the rotating rollers 336 receive an upward external force from the level difference, and the entirety of the cleaning unit 30 is moved upward by the upward external force. As a result, the intake nozzle 33 coming into contact with the level difference can be avoided, and a damage, abnormal movement, toppling over, or the like that is incurred due to the contact between the intake nozzle 33 and the level difference can be avoided.

Also, the dial unit 62 is provided in the support holder 32 such that a rotational operation can be received, and the rotating cam 80 is attached to the shaft 77 of the dial unit 62. Therefore, the user can easily adjust the limit position of the cleaning unit 30 by operating the dial unit 62. Therefore, when the cleaning unit 30 is caused to move without performing cleaning operation, for example, the intake nozzle 33 of the cleaning unit 30 can be easily retracted to an upward position at which the intake nozzle 33 will not come into contact with a level difference.

Also, the cleaning unit 30 includes the fixing mechanism for fixing the rotating cam 80 at the position determined by rotation operation of the rotating cam 80, and the fixing mechanism includes the lock plate 65 provided in the support holder 32 and the lock pin 74 that can be inserted into one of a plurality of engagement holes 66 that are formed in the lock plate 65. As a result of providing a fixing mechanism, the position of the cleaning unit 30 in the vertical direction can be easily adjusted by inserting the lock pin 74 into one of the engagement holes 66, and the cleaning unit 30 can be easily fixed to a desired position.

Also, the fixing mechanism includes the coil spring 78 as an elastic member, and therefore the state in which the lock pin 74 is inserted into one engagement hole 66 can be maintained by the elastic force of the coil spring 78. Accordingly, the fixing by the fixing mechanism will not be released due to vibration or the like when moving, and therefore a cleaning apparatus 10 that can safely move can be realized.

Also, in the present embodiment or embodiments, the dial units 62 are attached to the base portion 321 of the support holder 32, and when the collection box 31 is attached to the support holder 32, the dial units 62 are hidden by the collection box 31. Therefore, while the cleaning apparatus 10 is used, that is, when cleaning is in progress or when moving, the dial units 62 are not exposed to the outside. Therefore, the dial units 62 are prevented from being inadvertently operated while the cleaning apparatus 10 is operating, and therefore the safety of the cleaning apparatus 10 during operation can be ensured. Also, the adjustment dials 70 of the dial units 62 are exposed such that an operation can be received by merely removing the collection box 31 that can be attached to and removed from the support holder 32. Therefore, the user can easily access the adjustment dials 70, and easily operate the adjustment dials 70.

Note that, in the present embodiment or embodiments, a configuration in which the cleaning unit 30 is provided with two dial units 62 is illustrated, but one or more embodiments is not limited to the above described configuration. One dial unit 62 may be provided at the center in the width direction D3, or three or more dial units 62 may also be provided side by side in the width direction D3 at equal intervals.

INDEX TO THE REFERENCE NUMERALS

10 Cleaning apparatus
11 Apparatus body
12 Moving unit
13 Motor
23 Floor surface
30 Cleaning unit
31 Collection box
32 Support holder
33 Intake nozzle
34 Extension nozzle
35 Cover
39 Transmission mechanism
50 Sliding mechanism
60 Position adjustment mechanism
61 Support shaft
62 Dial unit
65 Lock plate
66 Engagement hole
67, 68 Stopper
70 Adjustment dial
71 Dial body
72 Lock member
73 Projection piece
74 Lock pin
77 Shaft
77A Hook
77B Hook
78 Coil spring
80 Rotating cam
321 Base portion
322 Housing portion
323 Opening
324 Bottom plate
325 Bracket
331 Suction port
332 Outer circumferential wall
334 Side plate
336 Rotating roller
801, 802, 803 Cam face

The invention claimed is:

1. A cleaning apparatus for cleaning a surface to be cleaned while moving on the surface to be cleaned, the cleaning apparatus comprising:

an apparatus body; and a cleaning unit that is supported so that the cleaning unit is movable to retreat upward from a limit position in a vertical direction relative to the apparatus body and movable downward to return to the limit position, and is kept from moving downwardly from the limit position, wherein the apparatus body comprises a shaft as a positioning member configured to position the cleaning unit at the limit position, the cleaning unit comprises:

an intake nozzle that is arranged at a position separated by a predetermined gap from the surface to be cleaned;

a cam member configured to hold the cleaning unit at the limit position by a cam face being supported on an upper face of the positioning member; and an adjustment dial as an operation input unit configured to apply, to the cam member, a force in a rotating direction of the cam member, and to change the limit position to a higher position by moving the cleaning unit upward by operating the cam member.

2. The cleaning apparatus according to claim 1, wherein the cleaning unit comprises a rotator that is provided in the cleaning unit such that outer circumferential surface of the rotator is positioned between a circumferential edge portion of a suction port of the intake nozzle and the surface to be cleaned, and the cleaning unit is configured to retreat upward from the limit position by the cam member separating upward from the positioning member due to an upward external force being applied to the rotator, and return to the limit position by the cam member coming into contact with the upper face of the positioning member due to the external force being canceled.

3. The cleaning apparatus according to claim 2, wherein the cleaning unit comprises:

a collection box configured to collect objects to be suctioned in that are suctioned in through the suction port; and a support member that is provided with the intake nozzle in a lower end portion, and is configured to support the collection box above the intake nozzle, and be supported by a back face of the apparatus body so that the support member is movable in a vertical direction, and the operation input unit is provided in the support member such that a rotational operation can be received, and the cam member is attached to a rotating shaft of the operation input unit.

4. The cleaning apparatus according to claim 3, wherein the cleaning unit comprises a protrusion as a fixing mechanism configured to fix the cam member at a position determined by rotation operation of the cam member.

5. The cleaning apparatus according to claim 4, wherein the fixing mechanism comprises:

a fixing plate that is provided in the support member, and in which a plurality of engagement holes are formed; and a lock member that is provided in the operation input unit, and comprises a protrusion that can be inserted into the engagement holes.

6. The cleaning apparatus according to claim 5, wherein the fixing mechanism further comprises an elastic member that applies a force to the lock member in a direction in which the protrusion approaches the engagement holes.

7. The cleaning apparatus according to claim 3, wherein the support member comprises a housing portion having a recessed shape that is recessed on a side of the back face for accommodating the collection box, and is configured to support the collection box such that the collection box can be attached and detached, and the operation input unit is provided in a side face on the side of the back face of the housing portion.

8. The cleaning apparatus according to claim 1, further comprising:

a drive transmission configured to transmit a moving force in a moving direction of the cleaning apparatus to the surface to be cleaned while keeping a moving posture of the apparatus body.

* * * * *